US007909662B2

(12) United States Patent
Gathman et al.

(10) Patent No.: US 7,909,662 B2
(45) Date of Patent: Mar. 22, 2011

(54) BATTERY CLAMP FOR USE WITH TOP POST AND SIDE POST BATTERIES AND METHODS FOR USING THE SAME

(75) Inventors: Michael R. Gathman, Genoa, IL (US); Richard S. Smith, Sycamore, IL (US)

(73) Assignee: Auto Meter Products, Inc., Sycamore, IL (US)

( * ) Notice: Subject to any disclaimer, the term of this patent is extended or adjusted under 35 U.S.C. 154(b) by 0 days.

(21) Appl. No.: 12/700,523

(22) Filed: Feb. 4, 2010

(65) Prior Publication Data

US 2010/0136854 A1 Jun. 3, 2010

Related U.S. Application Data

(62) Division of application No. 12/411,845, filed on Mar. 26, 2009, now Pat. No. 7,736,201.

(60) Provisional application No. 61/040,039, filed on Mar. 27, 2008, provisional application No. 61/091,964, filed on Aug. 26, 2008.

(51) Int. Cl.
*H01R 4/48* (2006.01)

(52) U.S. Cl. ..... 439/759

(58) Field of Classification Search ..... 439/757–759
See application file for complete search history.

(56) References Cited

U.S. PATENT DOCUMENTS

| | | | | |
|---|---|---|---|---|
| 4,565,414 | A | 1/1986 | French | 439/241 |
| 6,544,078 | B2 * | 4/2003 | Palmisano et al. | 439/762 |
| 6,623,314 | B1 * | 9/2003 | Cox et al. | 439/759 |
| 7,598,699 | B2 * | 10/2009 | Restaino et al. | 320/105 |

OTHER PUBLICATIONS

Use of Lead Adapter Posts with Side Post Batteries (prior to Mar. 27, 2008, 2 pages)

* cited by examiner

*Primary Examiner* — Javaid Nasri
(74) *Attorney, Agent, or Firm* — Nixon Peabody LLP

(57) ABSTRACT

A battery clamp for use with (a) top post terminal connections and (b) batteries with side post terminal connections includes a first and a second jaw handle. The first and second jaw handles each have a handle portion and a clamping portion. The first and second jaw handles are pivotally coupled to each other and are biased with the clamping portions in a closed position. The battery clamp further includes a side post adapter. The side post adapter is coupled to the handle portion of one of the jaw handles. The side post adapter includes a load pad and a volt rod. The load pad has an aperture, through which a portion of the volt rod protrudes.

20 Claims, 26 Drawing Sheets

BATTERY CLAMP FOR USE WITH TOP POST AND SIDE POST BATTERIES AND METHODS FOR USING THE SAME

CROSS-REFERENCE TO RELATED APPLICATIONS

This application is a divisional of U.S. Application No. 12/411,845, filed Mar. 26, 2009, now U.S. Patent No. 7,736,201, which claims the benefit of U.S. Provisional Application No. 61/040,039, filed Mar. 27, 2008, and U.S. Provisional Application No. 61/091,964, filed Aug. 26, 2008, all of which are hereby incorporated by reference herein in their entireties.

FIELD OF THE INVENTION

The field of the invention relates generally to battery clamps for testing and/or charging batteries with top post and/or side post terminal connections. More particularly, the present invention relates to battery clamps with side post adapters and methods of using the same to charge and/or test batteries.

BACKGROUND OF THE INVENTION

In the automotive battery field, automotive technicians use battery clamps to electrically connect a battery to a charging/testing device. According to some embodiments, it is important for these battery clamps to have a secure physical and a secure electrical connection with the battery's terminals. A poor connection can result in damage to the battery, damage to the charging/testing device, injury to the operator, and it can impact the accuracy of test results. For example, poor connections can lead to the generation of heat, which can cause the battery terminals to melt and possibly cause the battery to explode in some cases.

Generally there are three types of automotive batteries: (1) top post terminal batteries, (2) side post terminal batteries, and (3) dual post terminal batteries (e.g. universal fit-type batteries). Top post terminal batteries include two lead post terminals that protrude upwardly from the top of the battery. Installing a top post terminal battery in a vehicle such as an automobile involves attaching electrical cables to each of the two lead post terminals. Even while a vehicle's electrical cables remain attached to a top post battery, the lead posts typically provide a sufficient surface for mechanically and electrically connecting a pair of standard battery clamps to perform a test and/or charge of the battery.

Side post terminal batteries, on the other hand, generally consist of two lead pad terminals on the side of the battery, each terminal having a threaded bore. The threaded bore is typically made of stainless steel to prevent corrosion of the battery terminal. Installing a side post terminal battery in a vehicle such as an automobile involves attaching electrical cables to each of the two lead pads using a steel bolt. The electrical cables generally have a loop attached to the end of the cable. The steel bolt fits through the loop and mates with the threaded bore portion of the terminal, keeping the cable in physical and electrical contact with the lead pad portion of the side post terminal battery.

Dual post terminal batteries are a combination of a top post terminal battery and a side post terminal battery. Dual post terminal batteries have four terminals, two on the top (e.g., top post terminals) and two on the side (e.g., side post terminals). Dual post terminal batteries are typically supplied with plastic or rubber covers to electrically insulate/cover the two terminals not in use.

To charge or test a top post terminal battery, for example, an automotive technician connects a pair of battery clamps onto two respective top post terminals protruding from the top of the battery. This traditional method of "clamping" a battery clamp onto each terminal is sufficient for testing/charging a top post terminal battery because there is typically enough surface area on the top post terminals to allow for a proper and secure connection, even when the battery remains connected to the vehicle.

To test or charge a side post terminal battery, for example, an automotive technician generally connects a pair of standard battery clamps onto steel bolts that hold a vehicle's electrical cables in contact with the side post terminals of the battery. While connecting standard battery clamps onto the steel bolts is possible, it is difficult and less accurate than other methods. Prior solutions to the minimal surface area problem involved, for example, an automotive technician disconnecting the steel bolts and electrical cables from the battery and using lead adapter posts. According to such a method, the technician screws a lead adapter post into each of the side post terminals of the battery. The lead adapter posts, when connected, essentially convert the side post terminal battery into a top post terminal battery, only having the posts on the side of the battery. The lead adapter posts are designed to provide a sufficient surface for attaching standard battery clamps. The technician can attach the lead adapter posts to the battery while the battery remains in the vehicle or after the battery has been removed from the vehicle.

However, lead adapter posts are small and are easily lost or misplaced in automotive repair/testing shops. Typically, when technicians lose or misplace their lead adapter posts, they often substitute a standard steel bolt to provide a method of attaching the standard battery clamps; however, the steel bolts only contact the threaded bore portion of the side post terminal. For example, FIG. 2*a* depicts a cross-sectional view of a side post battery 200 having a standard steel bolt 210 connected to a side post terminal 220. Noticeably, the steel bolt 210 does not physically contact the lead pad portion 222 of the side post terminal 220. Rather, the steel bolt 210 only makes contact with the stainless steel threaded bore portion 224 of the side post terminal 220. Such an arrangement can yield both inaccurate battery test results and also generate significant amounts of heat that can melt and destroy the side post battery 200. Conversely, FIG. 2*b* depicts a cross-sectional view of a side post battery 230 having a lead adapter post 240 connected to a side post terminal 250. Noticeably, the side post adapter 240 makes an electrical and physical connection with both a stainless steel threaded bore portion 254 and with a lead pad portion 252 of the side post terminal 250.

What is needed is a battery clamp that can easily, safely, and reliably connect to both top post terminal and side post terminal batteries without the necessity of an independent lead adapter post. What is also needed is a battery clamp that can connect to side post terminals and provide accurate battery testing results.

SUMMARY OF THE INVENTION

According to some embodiments, a battery clamp for use with (a) top post terminal connections and (b) batteries with side post terminal connections includes a first and a second jaw handle. The first and second jaw handles each have a handle portion and a clamping portion. The first and second jaw handles are pivotally coupled to each other and are biased with the clamping portions in a closed position. The battery clamp further includes a first and second jaw member. The jaw members have a jaw clamp portion, a jaw pivot portion, and a jaw wire portion. The jaw pivot portion of the first jaw member and the jaw pivot portion of the second jaw member are both pivotally coupled to the first and second jaw handles. The battery clamp further includes, a load pad and a volt rod. The load pad has an aperture and is operatively coupled to the first jaw member. The volt rod is operatively coupled to the second jaw member and protrudes through the aperture of the load pad.

According to some embodiments, a battery clamp for use with (a) top post terminal connections and (b) batteries with side post terminal connections includes a first and a second jaw handle. The first and second jaw handles each have a handle portion and a clamping portion. The first and second jaw handles are pivotally coupled to each other and are biased with the clamping portions in a closed position. The battery clamp further includes a side post adapter. The side post adapter is coupled to the handle portion of one of the jaw handles. The side post adapter includes a load pad and a volt rod. The load pad has an aperture, through which a portion of the volt rod protrudes.

According to some embodiments a method of testing a battery having side post terminal connections includes the acts of providing a pair of battery clamps, each having a side post adapter coupled thereto. The side post adapters each include a load pad and a volt rod. The method further including the acts of inserting each of the volt rods into a respective side post terminal in the battery and rotating each of the volt rods to cause the load pads to become electrically coupled to a respective lead pad on the battery. The method also including the acts of applying a load to the battery and measuring at least one of a current and a voltage of the battery.

According to some embodiments, a method of charging a battery having side post terminal connections includes the acts of providing a pair of battery clamps. The battery clamps each have a side post adapter coupled thereto. Each side post adapter includes a load pad and a volt rod. The method further includes the acts of inserting each of the volt rods into a respective side post terminal in the battery, rotating each of the volt rods to cause the load pads to become electrically coupled to a respective lead pad on the battery, and applying a charge to the battery.

According to some embodiments, a method of testing a battery having top post terminal connections includes the acts of providing a pair of battery clamps. The battery clamps each have a side post adapter coupled thereto. Each side post adapter includes a load pad and a volt rod. The method further includes the acts of clamping each of the battery clamps onto a respective top post terminal on the battery, applying a load to the battery, and measuring at least one of a current and a voltage of the battery.

According to some embodiments, a battery clamp for use with (a) batteries with top post terminal connections and (b) batteries with side post terminal connections includes a first and second jaw handle. Each of the first and second jaw handles include a handle portion and a clamping portion. The first and second jaw handles are pivotally coupled together. The jaw handles are biased with the clamping portions in a substantially closed position. The battery clamp further includes a jaw member insulator coupled to the clamping portion of the first jaw handle and a jaw member coupled to the jaw member insulator. The jaw member insulator electrically insulates the jaw member from the first and second jaw handles. The battery clamp further includes a load pad electrically coupled to the jaw member, the load pad having an aperture, and a volt rod electrically coupled to the first and second jaw handles. A portion of the volt rod protrudes through the aperture of the load pad.

According to some embodiments, a battery clamp for use with (a) batteries with top post terminal connections and (b) batteries with side post terminal connections includes a first and second jaw handle. The first and second jaw handles each have a handle portion and a clamping portion. The first and second jaw handles are pivotally coupled together and are biased with the clamping portions in a substantially closed position, the clamping portions being configured to be coupled to a top-post terminal of a top-post battery. The battery clamp further includes a jaw member coupled to the clamping portion of the first jaw handle and a side post adapter configured to be coupled to a side-post terminal of a side-post battery. The side post adapter includes a load pad and a volt rod. The battery clamp further includes a volt wire electrically coupled to the volt rod, a load wire electrically coupled to the load pad, and a load jumper wire electrically coupled between the load pad and the jaw member.

According to some embodiments, a battery clamp for use with (a) batteries with top post terminal connections and (b) batteries with side post terminal connections includes a first and second jaw handle. The first and second jaw handles each have a handle portion and a clamping portion. The first and second jaw handles are pivotally coupled to each other and are biased with the clamping portions in a substantially closed position. The clamping portions are configured to be coupled to a top-post terminal of a top-post battery. The battery clamp further includes a jaw member insulator coupled to the clamping portion of the first jaw handle and a jaw member coupled to the jaw member insulator, the jaw member being electrically insulated from the first and second jaw handles. The battery clamp further includes a side post adapter that is coupled to the handle portion of the first jaw handle. The side post adapter includes a load pad and a volt rod, the load pad having an aperture, a portion of the volt rod protruding through the aperture of the load pad.

Additional aspects and other advantages of the invention will become apparent upon reading the following detailed description and upon reference to the drawings.

BRIEF DESCRIPTION OF THE DRAWINGS

In the following, certain embodiments of the invention will be described with reference to the drawings, wherein.

Figure 1A:
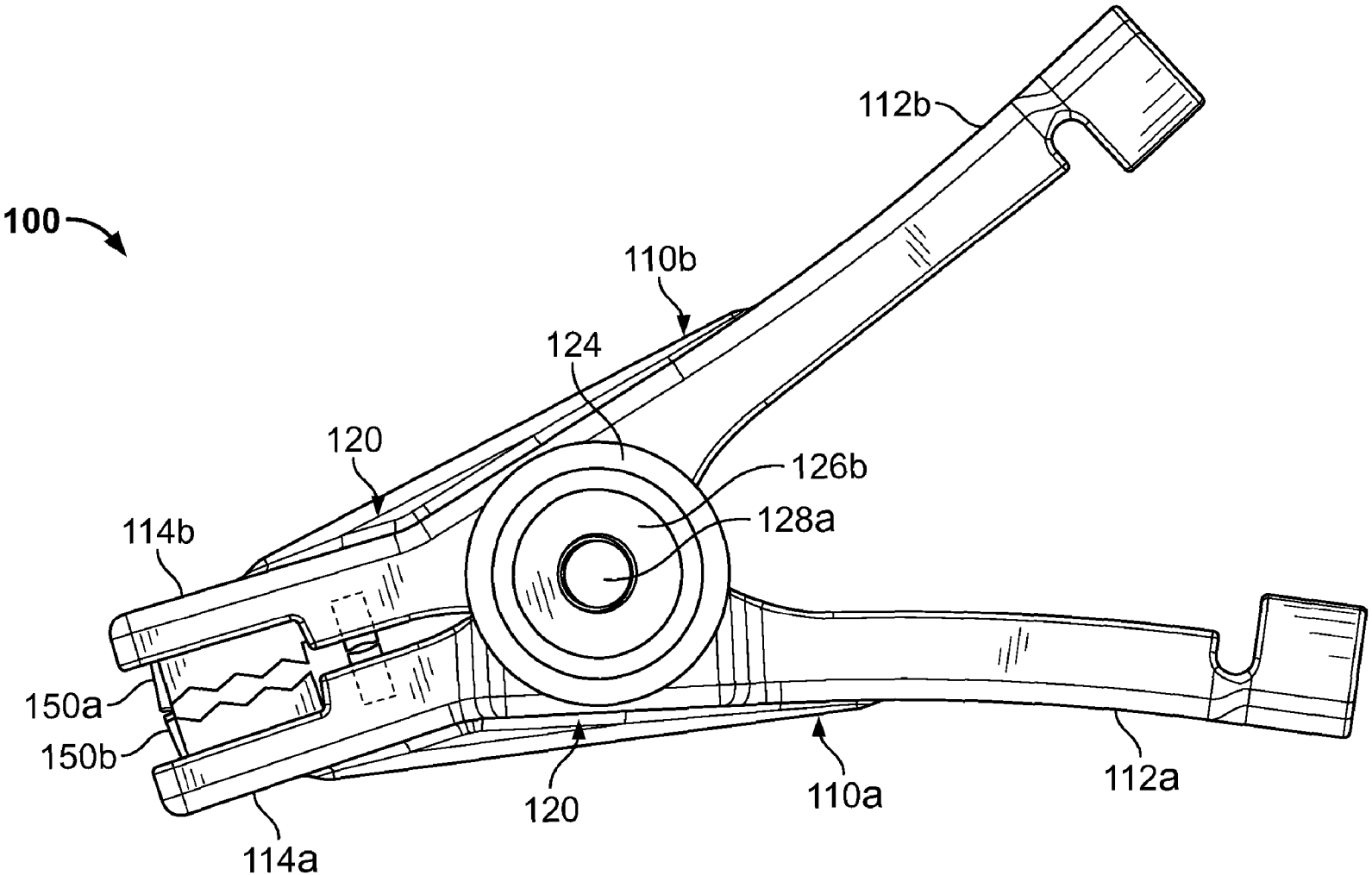
FIG. 1A is a side view of one side of a battery clamp according to some embodiments of the present disclosure.
Figure 1B:
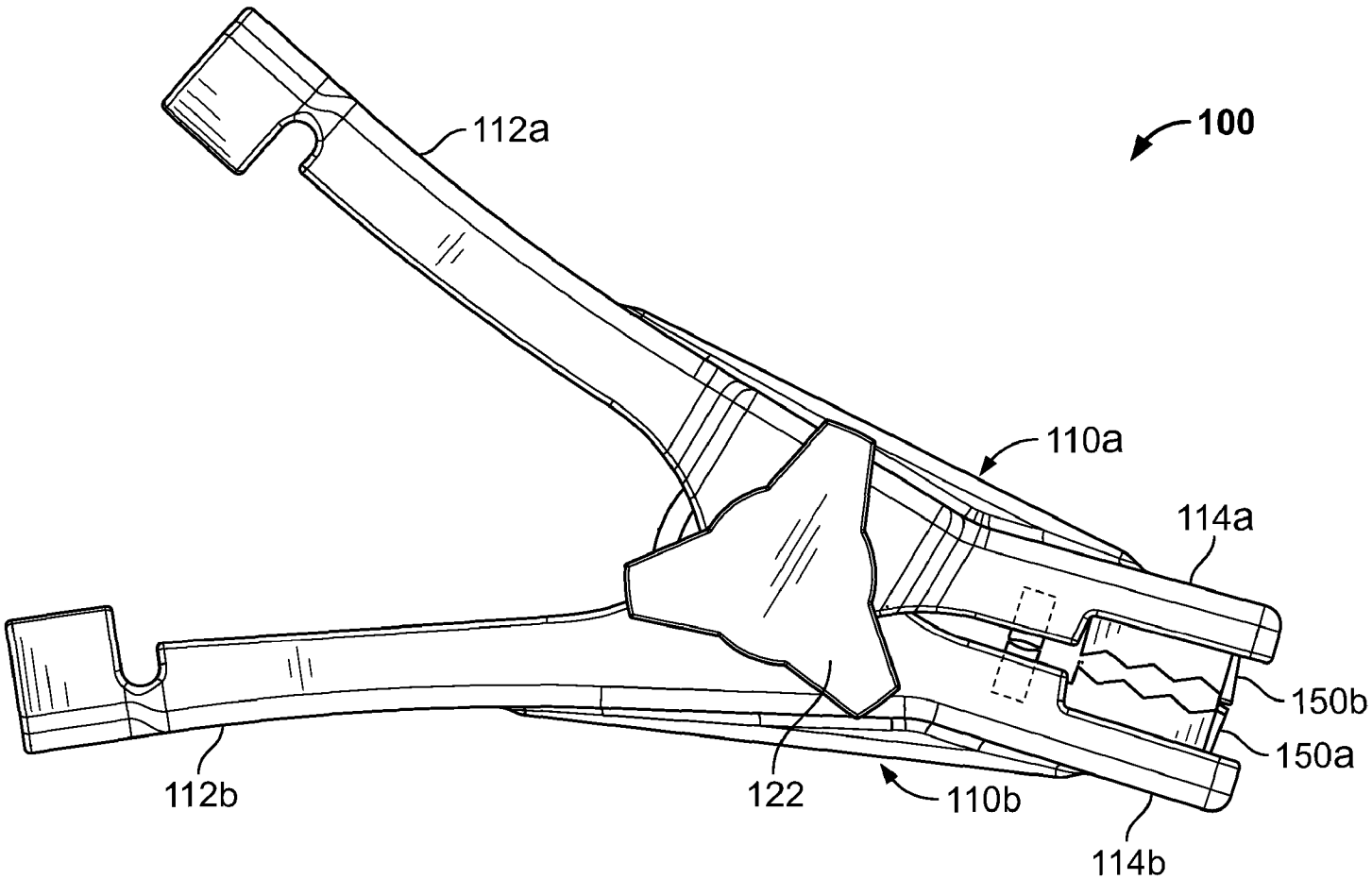
FIG. 1B is a side view of the other side of the battery clamp of FIG. 1A.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF ILLUSTRATIVE EMBODIMENTS

According to certain embodiments, FIGS. 1A-F, depict a battery clamp 100 for testing and charging both batteries with top post terminal connections and batteries with side post terminal connections. The battery clamp 100 includes a first jaw handle 110*a*, a second jaw handle 110*b*, a first jaw member 150*a*, a second jaw member 150*b*, and a side post adapter assembly 120. The first and second jaw handles 110*a,b* each have a handle portion 112*a,b* and a clamping portion 114*a,b*. It is contemplated that according to certain embodiments, the first and second jaw handles 110*a,b* can be formed from various materials, including but not limited to, steel, carbon, copper, iron, aluminum, plastic and combinations thereof.

According to some embodiments, the first and second jaw handles 110*a,b* are formed from an insulating or non-conductive material such as plastic because, for example, plastic jaw handles provide a simplified design and added safety. Similarly, plastic jaw handles electrically insulate the jaw handles from one another. For example, according to some embodiments, the first and second jaw handles 110*a,b* are made from a non-conductive material (e.g. plastic) to prevent a pair of battery clamps (e.g. two of battery clamp 100) from touching and shorting one another while connected to respective terminals of a battery. Similarly, non-conductive jaw handles prevent a battery clamp from causing a short should the handles touch a chassis of, for example, an automobile.

Figure 7:
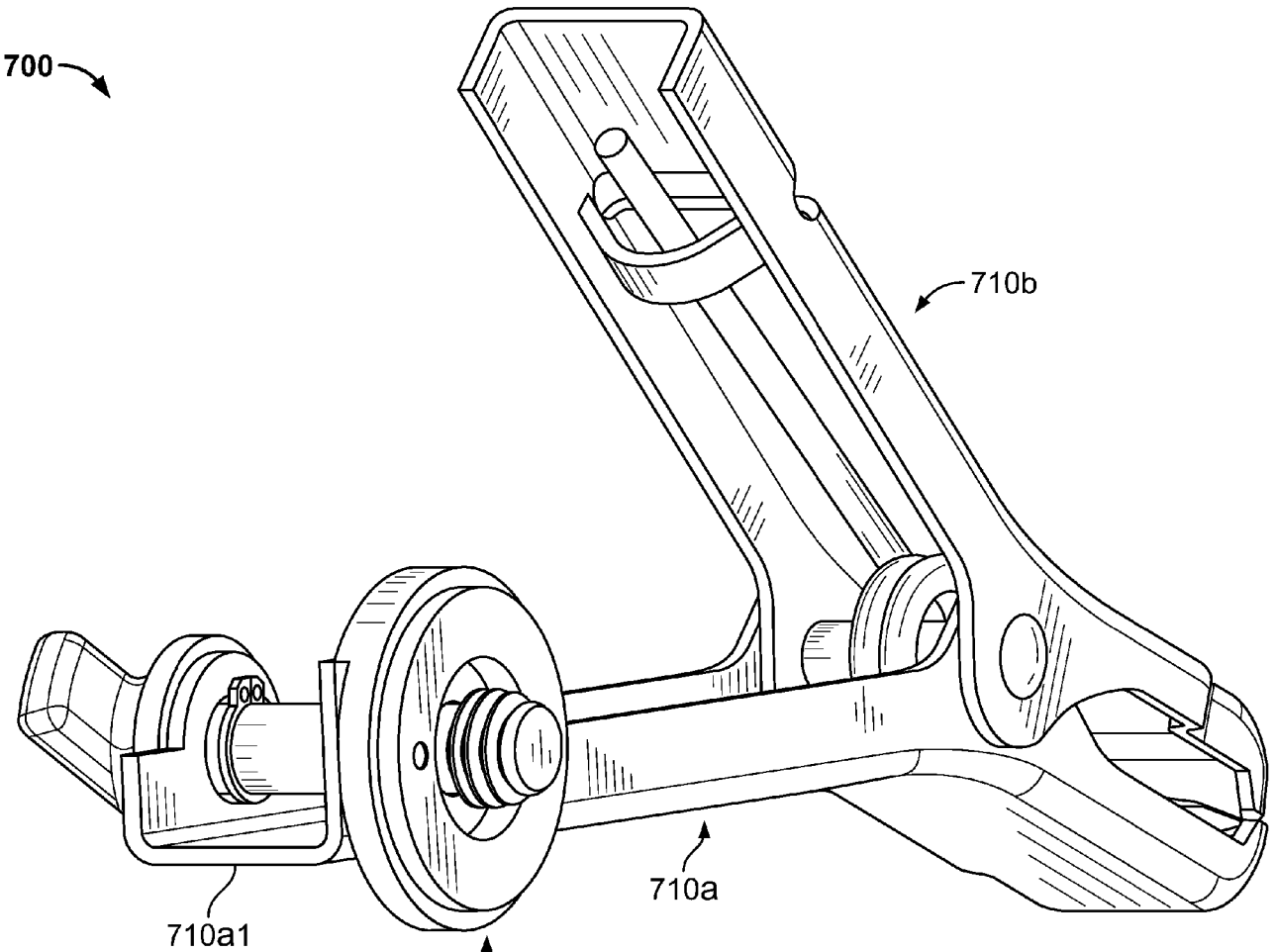
FIG. 7 is a perspective view of a battery clamp according to some embodiments of the present disclosure.

According to certain embodiments, the first and second jaw handles 110*a,b* are substantially the same in design. According to certain embodiments, the first and the second jaw handles 110*a,b* each further include at least one aperture. In certain embodiments, as shown in FIG. 1E, the first jaw handle 110*a* includes a first aperture 118*a* and a second aperture 118*b*, and the second jaw handle 110*b* includes a third aperture 118*c* and a fourth aperture 118*d*. According to some embodiments, when the first jaw handle 110*a* is attached or coupled to the second jaw handle 110*b*, the first and the third apertures 118*a,c* are aligned with each other to form a first pivot point 116*a*, as shown in FIG. 1C. Similarly, the second and the fourth apertures 118*b,d* become aligned to form a second pivot point 116*b*. It is contemplated that various combinations exist for the number and location of apertures for the jaw handles. For example, in certain embodiments, a first and second jaw handle may contain two apertures each. In certain other embodiments, a first jaw handle may contain two apertures and a second jaw handle may contain one aperture. In some embodiments, the jaw handles do not have apertures or do not have apertures at a pivot point between the two handles. In these embodiments, a side post adapter assembly can be coupled to, for example, a handle portion of either of the two jaw handles or above or below a pivot portion of the two jaw handles. For example, FIG. 7 is a perspective view of a battery clamp 700 according to some embodiments of the present disclosure. The battery clamp 700 comprises a first and a second jaw handle 710*a,b* and a side post adapter assembly 720. As depicted in FIG. 7, the side post adapter assembly 720 is coupled to the first jaw handle 710*a* near an end 710*a*1 of the first jaw handle 710*a*.

In certain embodiments, the side post adapter assembly 120 is attached or coupled to the battery clamp 100 through the first and second pivot points 116*a,b*. The connection of the side post adapter assembly 120 pivotally connects the two jaw handles 110*a,b*. In certain embodiments, the jaw handles 110*a,b* are biased in closed position by a biasing member 117, as shown in FIGS. 1C, 1D, and 1E. The biasing member 117 biases the clamping portions 114*a,b* towards each other. It is contemplated that the biasing member 117 can be of a variety of configurations such as, but not limited to, a torsion spring, a coil spring, a leaf spring, or a memory spring. To open the clamping portions 114*a,b*, for example, an operator squeezes the handle portions 112*a,b* together. According to some embodiments, the biasing member 117 is located between the first and second jaw member 150*a,b* (described in detail below). According to some embodiments, a spacer 140 (described in detail below) fits through a portion of the biasing member 117. It is contemplated that according to some embodiments, a side post adapter assembly can be attached to a battery clamp at various other locations, including but not limited to, the handle portion of one of the jaw handles.

Figure 1C:
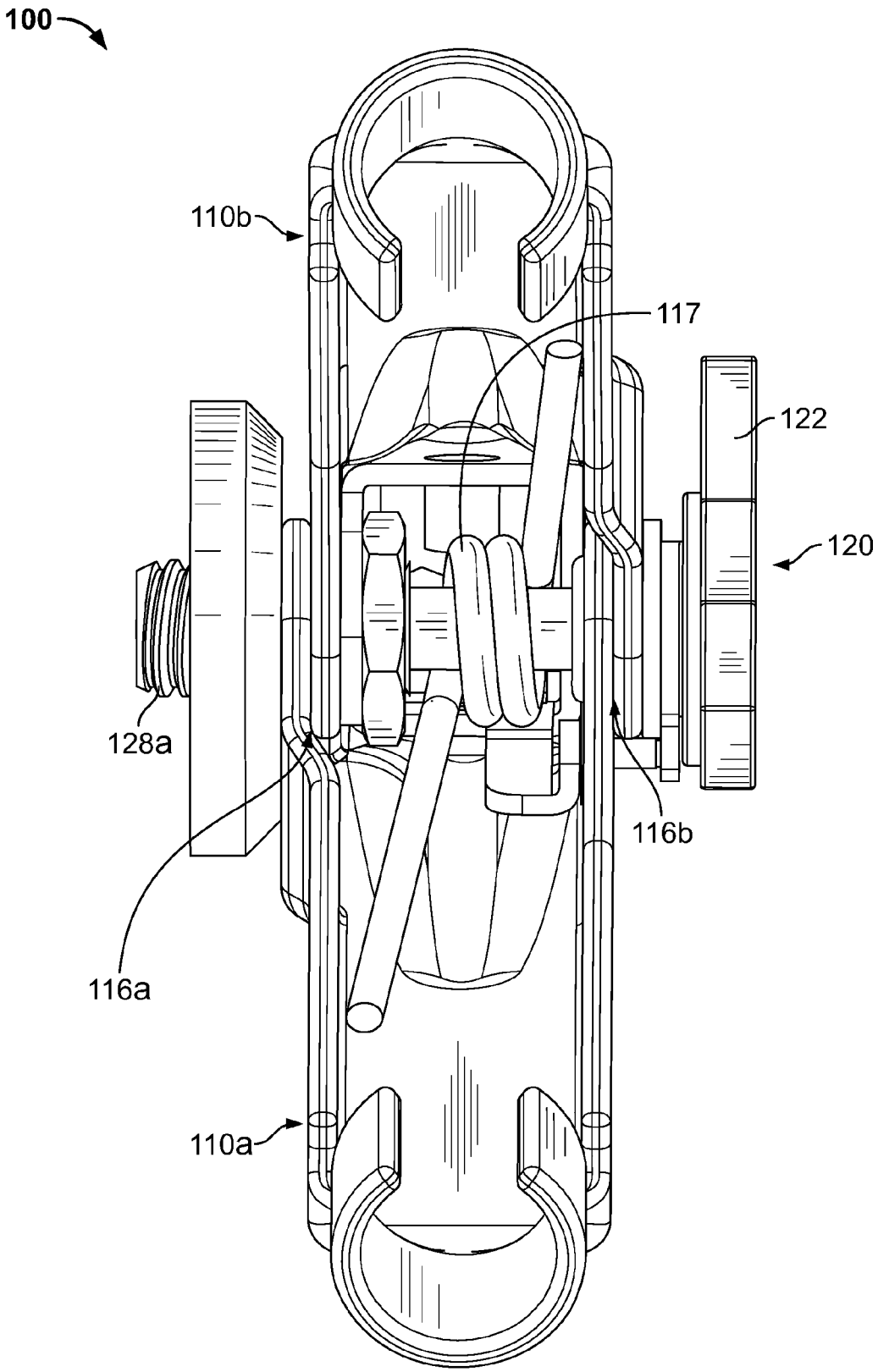
FIG. 1C is a rear view of the battery clamp of FIG. 1A.
Figure 1D:
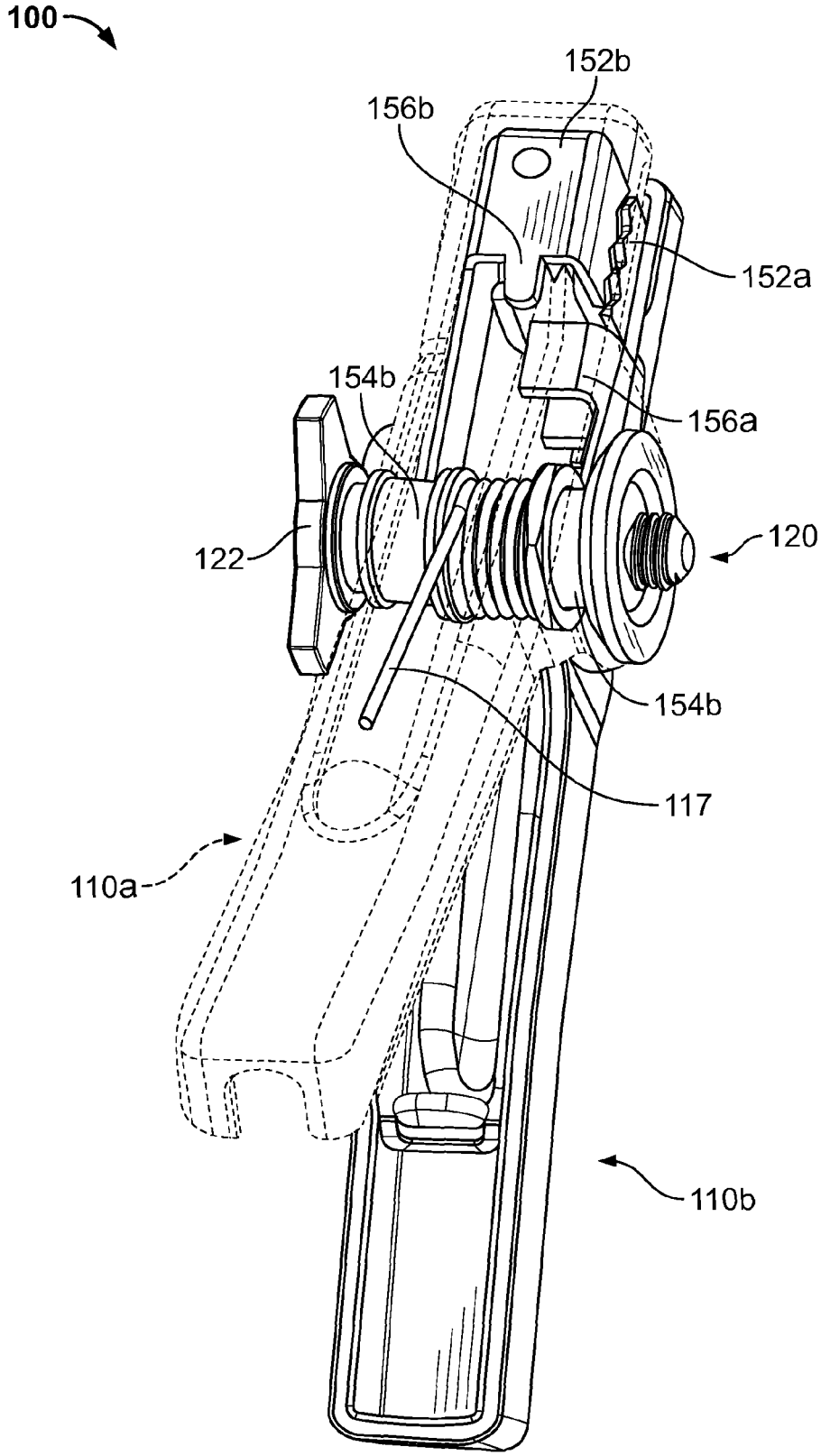
FIG. 1D is a partial perspective view of the battery clamp of FIG. 1A.
Figure 1E:
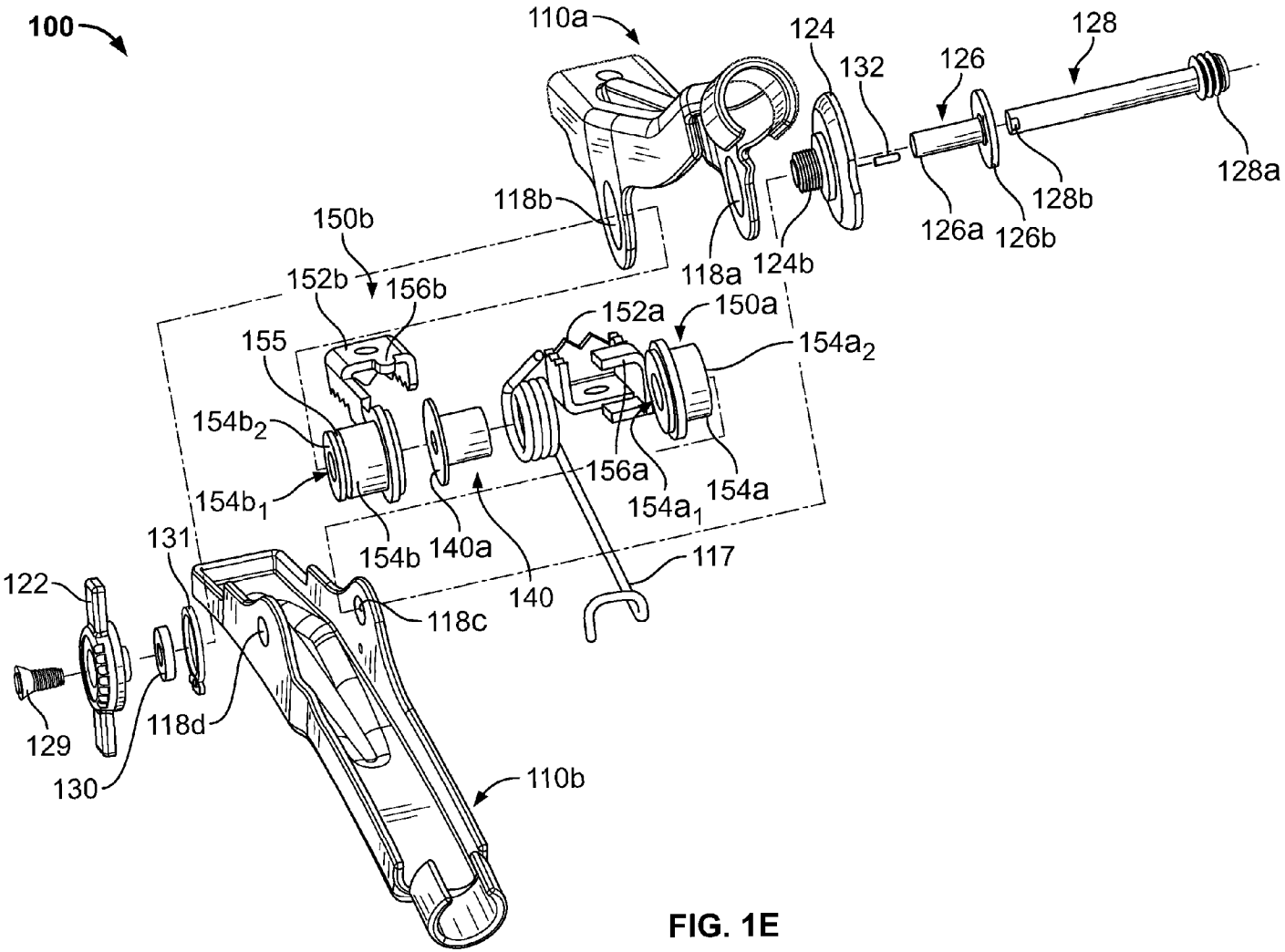
FIG. 1E is an exploded view of the battery clamp of FIG. 1A.

Referring to FIG. 1E, according to certain embodiments, the side post adapter assembly 120, as shown in FIGS. 1A, 1C, and 1D, includes a handle 122, a load pad 124, an insulating member 126, and a volt rod 128. The handle 122, also shown in FIGS. 1B-F, can be formed in a variety of shapes, for example, a knob, a turn screw, a wheel, or a sprocket. In certain embodiments, the handle 122 contains an aperture to receive a portion of the volt rod 128. The handle 122 can be formed from various materials including, but not limited to, plastic, carbon, copper, brass, steel, and/or aluminum. According to some embodiments, the handle 122 is formed from a non-conductive material, such as a plastic material to electrically insulate the volt rod 128, thereby inhibiting the battery clamp 100 from shorting through the handle 122 should the handle 122 come in contact with, for example, a chassis of an automobile during use, as well as, insulating an operator.

Figure 1F:
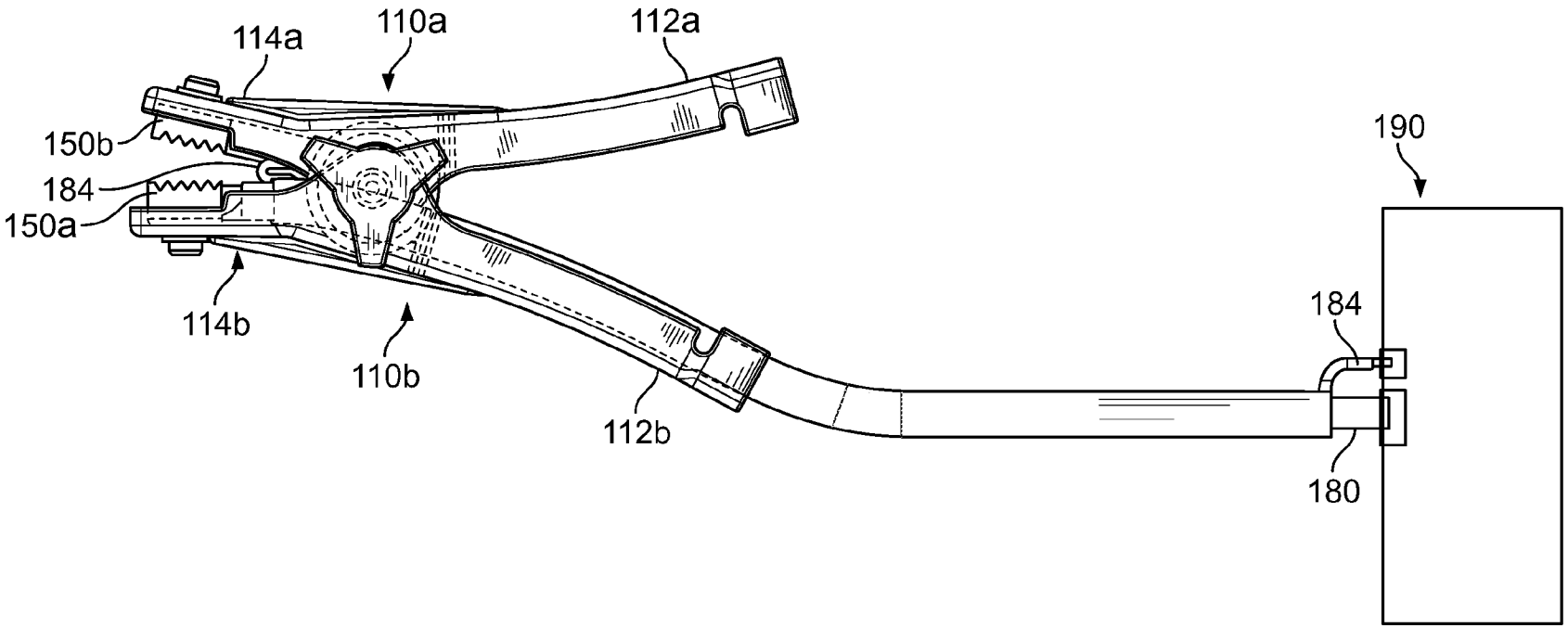
FIG. 1F is a side view of the battery clamp of FIG. 1A connected to a testing and/or charging device.
Figure 1G:
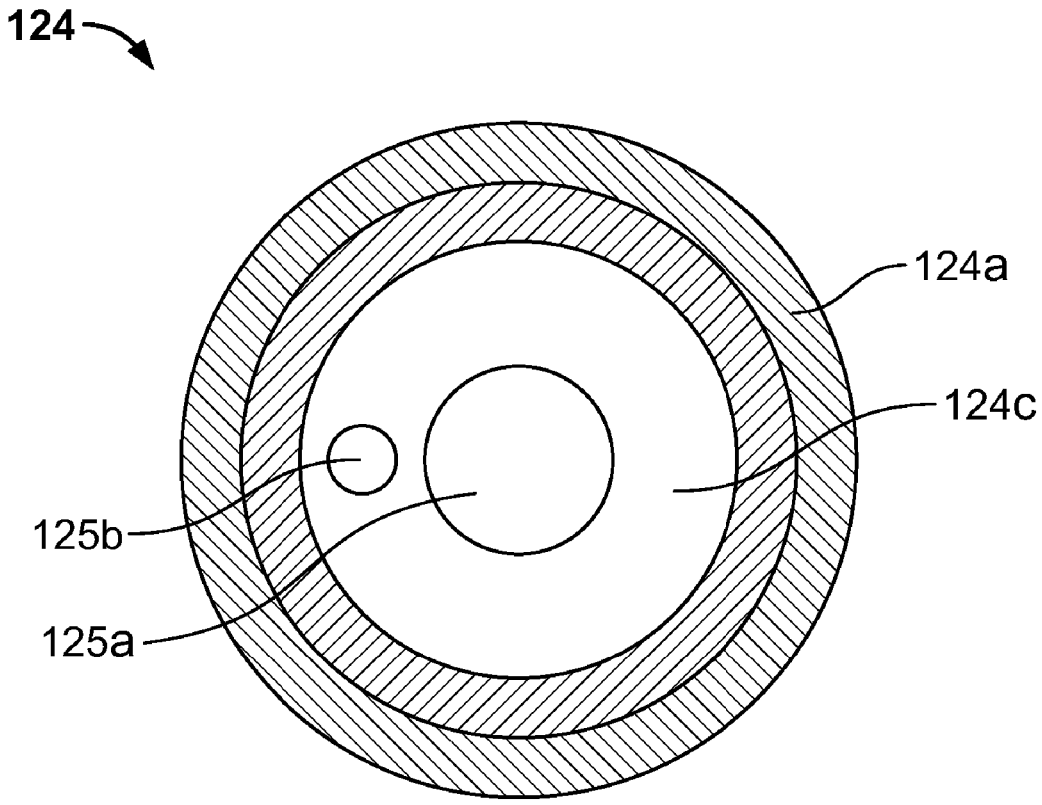
FIG. 1G is a front view of a load pad according to some embodiments of the present disclosure.
Figure 2A:
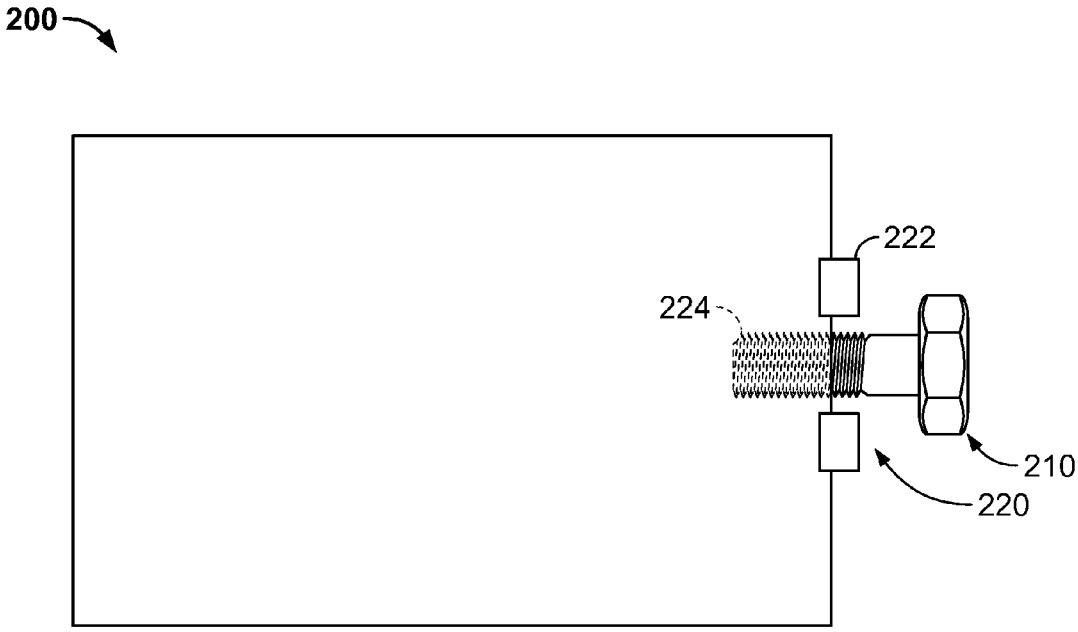
FIG. 2A is a cross-sectional view of a side post terminal having a steel bolt connected thereto.
Figure 2B:
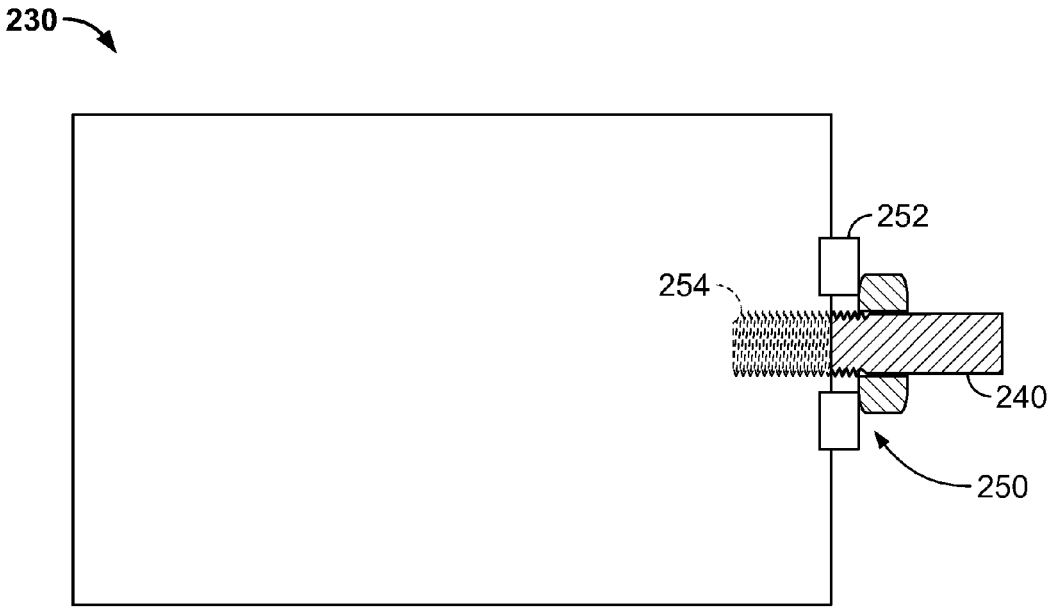
FIG. 2B is a cross-sectional view of a side post terminal having a side post adapter connected thereto.

Referring to FIG. 1G, according to some embodiments, the load pad 124 has a generally circular face 124*a* with an aperture 125*a*. The aperture 125*a* is configured to receive the insulating member 126 and a portion of the volt rod 128. In certain embodiments, the load pad's face 124*a* contains a recess 124*c* adapted to mate with a portion of the insulating member 126.

Referring back to FIG. 1E, according to some embodiments, the load pad 124 is electrically connected with the first jaw member 150*a*. In certain embodiments, the load pad 124 includes a threaded portion 124*b* configured to electrically connect with the first jaw member 150*a*. It is contemplated that in certain embodiments, the load pad 124 is electrically connected to the first jaw member 150*a* by a threaded connection, a pin connection, a solder connection, a wire connection, and/or a press fit connection.

It is contemplated that in some embodiments, the load pad 124 is configured to be electrically and mechanically connected to the first jaw member 150*a*. According to some embodiments, the load pad 124 can optionally include a second aperture 125*b*, as shown in FIG. 1G. The second aperture 125*b* may receive a pin 132, as shown in FIG. 1E. It is contemplated that the pin 132 can be, for example, a spring loaded pin. In certain embodiments, the pin 132 fits through the second aperture 125*b* and into the first jaw member 150*a* to inhibit the load pad 124 from coming unthreaded from the first jaw member 150*a*.

Figure 3:
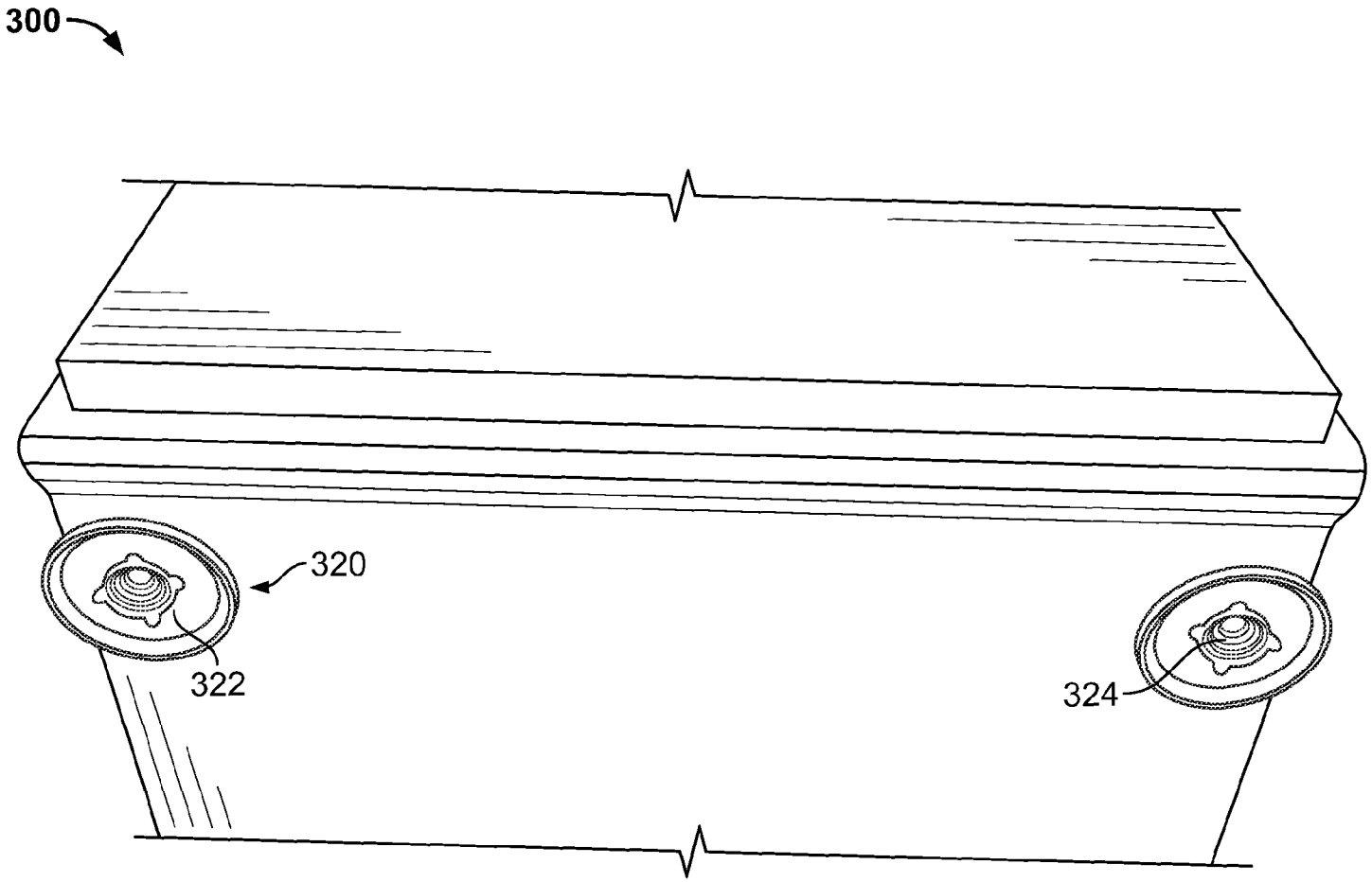
FIG. 3 is a perspective view of a battery having side post terminals.

It is contemplated that the load pad 124 can be formed from a variety of electrically conducting materials including, but not limited to, brass, carbon, copper, and/or steel. According to some embodiments, the load pad 124 is formed from brass due to the electrical conductivity characteristics, strength, and soldering ability of brass. It is contemplated that the load pad 124 can be formed in any of a variety of shapes that are suitable for forming an electrical connection with a lead pad of a side post terminal of a battery. FIG. 3 depicts a typical lead pad 322 of a side post terminal battery 300.

Referring back to FIG. 1E, according to some embodiments, the volt rod 128 has a generally cylindrical shape with two opposing ends. The first end 128*a* includes a threaded portion and the second end 128*b* is substantially smooth. According to some embodiments, the volt rod 128 is electrically connected with the second jaw member 150*b*. The threaded portion 128*a*, also shown in FIGS. 1A and 1C, is adapted to mate with, for example, a side post terminal 320 of the battery 300. According to some embodiments, the first end 128*a*, having the threaded portion, is adapted to mate with an inner threaded bore portion 324 of the side post terminal 320 of the battery 300 whereby the threaded portion may be screwed into the threaded bore portion 324 of the side post terminal 320.

The volt rod 128 can be formed from any of a variety of electrically conducting materials including, but not limited to, brass, copper, steel, and/or stainless steel. According to some embodiments, the volt rod 128 is formed from one piece of stainless steel due to its resistance to rusting and/or corrosion. Specifically, stainless steel is a suitable material for a volt rod because a minimal amount of current is pulled through the volt rod during testing, which facilitates accurately measuring voltage differentials. According to some embodiments, the volt rod 128 is formed from more than one conducting material. For example, the first end 128*a* can be formed from stainless steel while the second end 128*b* can be formed from copper.

According to some embodiments, the handle 122 is rigidly, mechanically connected to the volt rod 128 such that when the handle 122 is turned, the volt rod 128 turns. According to some embodiments, the second end 128*b* of the volt rod 128 is configured to mechanically and electrically connect with a volt pad 130, as shown in FIG. 1E. According to certain embodiments, the volt rod 128 can be configured to connect with the volt pad 130 via a wedge connection, a screw connection, a pin connection, a key connection, a press fit connection, and/or a solder connection. For example, the volt rod 128 may be keyed with a notch for mating with the volt pad 130.

In certain embodiments, the second end 128*b* may have an inner threaded portion adapted to receive a screw 129, as shown in FIG. 1E. According to some embodiments, the screw 129 can be of any of a variety of lengths and have any of a variety of thread counts sufficient to secure the handle 122 to the volt rod 128 such that when the handle 122 rotates, the volt rod 128 rotates. According to some embodiments, the screw 129 secures the volt rod 128 to the volt pad 130. In certain embodiments, it is contemplated that the side post adapter assembly 120 does not include a screw 129, but that the second end 128*b* of the volt rod 128 is connected to the handle 122 by a threaded connection, a pin connection, a solder connection, a press fit connection, a wedge connection, and/or a key connection.

According to some embodiments, the volt pad 130 is configured to fit within a groove or lip in the handle 122. In certain embodiments, the volt pad 130 is coupled to the handle 122 such that when the handle 122 is securely coupled to the volt rod 128, the handle 122 forces the volt pad 130 into good electrical contact with the second jaw member 150*b*. The volt pad 130 provides additional surface area that electrically connects the volt rod 128 with the second jaw member 150*b*, in addition to the surface area of the volt rod 128 itself. The volt pad 130 eliminates or reduces the problem of grease and/or dirt accumulating between the volt rod 128 and the second jaw member 150*b* and impeding or interfering with the electrical connection between the volt rod 128 and the second jaw member 150*b* by providing additional electrical contact surface area.

The insulating member 126 electrically insulates the load pad 124 from the volt rod 128. The insulating member 126 includes a hollow tube-like portion 126*a* and a pad portion 126*b*, as shown in FIG. 1*e*. According to some embodiments, the hollow tube-like portion 126*a* is adapted to fit through the aperture 125*a* in the load pad 124. The insulating member 126 is configured to allow the second end 128*b* of the volt rod 128 to slide through the hollow tube-like portion 126*a*, while preventing the first end 128*a* from sliding through the insulating member 126. According to some embodiments, the hollow tube-like portion 126*a* of the insulating member 126 is formed with an inner diameter such that the second end 128*b* of the volt rod 128 can freely rotate within the insulating member 126. According to some embodiments, the pad portion 126*b* of the insulating member 126 abuts the face 124*a* of the load pad 124 and generally keeps the insulating member 126 from sliding all the way into the load pad aperture 125*a*. FIG. 1A shows the pad portion 126*b* of the insulating member 126 resting on top of the load pad face 124*a*. Optionally, the pad portion 126*b* of the insulating member 126 can fit within a recess 124*c* of the load pad 124. The insulating member 126 can be formed of a variety of insulating materials including, but not limited to, plastic.

Referring back to FIG. 1E, according to some embodiments, the jaw members 150*a,b* each contain jaw clamp portions 152*a,b*, jaw pivot portions 154*a,b*, and jaw wire connection portions 156*a,b*. The first jaw member 150*a* is also referred to as a load jaw. In certain embodiments, during operation of the battery clamp 100, the load jaw 150*a* is used to conduct current flowing from a battery to a measuring and/or charging device. The second jaw member 150*b* is also referred to as a volt jaw. In certain embodiments, during operation of the battery clamp device 100, the volt jaw 150*b* is used in measuring voltage across a battery's terminals.

The jaw clamp portions 152*a,b* of the jaw members 150*a,b* are adapted to be coupled to the clamping portions 114*a,b* of the jaw handles 110*a,b*. Specifically, the jaw clamp portion 152*a* of the first jaw member 150*a* is attached or coupled to the clamping portion 114*b* of the second jaw handle 110*b*. Similarly, the jaw clamp portion 152*b* of the second jaw member 150*b* is attached or coupled to the clamping portion 114*a* of the first jaw handle 110*a*. It is contemplated that in certain embodiments, the jaw clamp portions 152*a,b* can be connected or coupled to the clamping portions 114*a,b* of the jaw handles 110*a,b* in a variety of manners, such as with, for example, a screw connection, a glue connection, a solder connection, a nut and bolt connection, and/or a press fit connection.

The jaw pivot portions 154*a,b* are adapted to be pivotally coupled about the first and second pivot points 116*a,b*. According to some embodiments, the jaw pivot portion 154*a* of the first jaw member 150*a* is pivotally coupled about the first pivot point 116*a*. Similarly, the jaw pivot portion 154*b* of the second jaw member 150*b* is pivotally coupled about the second pivot point 116*b*. It is contemplated that in certain embodiments, the jaw pivot portions 154*a,b* can be coupled about the first and second pivot points 116*a,b* in a variety of manners, such as by, for example, a screw connection, a ring connection (e.g. a retainer ring), and/or a force fit connection. According to some embodiments, the jaw pivot portions 154*a,b* are pivotally coupled about the first and second pivot points 116*a,b* such that the jaw pivot portions 154*a,b* can freely rotate within the first, second, third, and fourth apertures 118*a,b,c,d* of the first and second jaw handles 110*a,b*. According to some embodiments, the jaw pivot portions 154*a,b* are maintained about the first and second pivot points 116*a,b* by the shaft of the volt rod 128 which passes through apertures 154*a*1, 154*b*1 in the jaw pivot portions 154*a,b*, and thereby permitting the first and second jaw members 150*a,b* to pivot about the shaft of the volt rod 128.

According to some embodiments, the side post adapter assembly 120 optionally includes a retainer ring 131, as shown in FIG. 1E. The retainer ring 131 can be configured to snap or clip into a groove 155 in an exterior end 154*b*2 of the jaw pivot portion 154*b* of the second jaw member 150*b*. The retainer ring 131 maintains the exterior end 154*b*2 of the jaw pivot portion 154*b* of the second jaw member 150*b* positioned through apertures 118*b,d*. It is contemplated that according to some embodiments, a retainer ring can be employed to maintain an exterior end 154*a*2 of the jaw pivot portion 154*a* of the first jaw member 150*a* positioned through apertures 118*a,c*.

According to certain embodiments, the side post adapter assembly 120 further includes a spacer element 140. The spacer element 140 generally fits between the first and second jaw members 150*a,b*. According to some embodiments, the spacer element 140 fits between the jaw pivot portions 154*a,b*. The spacer element 140 is designed to prevent the jaw pivot portion 154*a* of the first jaw member 150*a* from contacting or touching the jaw pivot portion 154*b* of the second jaw member 150*b* to prevent an electrical short during operation of the battery clamp 100. Essentially, the spacer element 140 electrically insulates the first jaw member 150*a* from the second jaw member 150*b* when the jaw handles 110*a,b* are biased in either an open or closed position.

According to some embodiments, the spacer element 140 is generally in the shape of a hollow tube to provide space for the volt rod 128 and the insulating member 126 to fit within the spacer element's 140 hollow core. Additionally, the spacer element 140 contains an aperture to allow the volt rod 128 to pass completely through and electrically connect with the jaw pivot portion 154*b* of the second jaw member 150*b*. In certain embodiments, the spacer element 140 also contains a lip portion 140*a*. According to some embodiments, the lip portion 140*a* is a generally flat pad connected or coupled to the hollow tube portion. According to some embodiments, the lip portion 140*a* and the tube portion of spacer 140 are integrally formed from a single piece of material such as plastic. The lip portion 140*a* is designed to abut the jaw pivot portion 154*b* of the second jaw member 150*b*. According to some embodiments, the spacer element 140 fits through the biasing member 117 such that the biasing member 117 pivots around the spacer 140 and electrically insulates the biasing member 117 from one or both of the jaw members 150*a,b*. The lip portion 140*a* essentially prevents an electrical short between the jaw pivot portion 154*a* of the first jaw member 150*a* and the jaw pivot portion 154*b* of the second jaw member 150*b* through the biasing member 117. It is contemplated that the spacer element 140 can be formed from any of a variety of non-conducting materials, including but not limited to, plastic. It is also contemplated that according to some embodiments, the spacer element 140 can include a second lip portion that abuts the jaw pivot portion 154*a* of the first jaw member 150*a*. In such embodiments, the spacer element can be formed from multiple pieces or the biasing member can be formed around the hollow core of the spacer element 140.

As shown in FIG. 1F, the jaw wire connection portions 156*a,b* are adapted to be operatively connected with, or coupled to, electrical wires. Specifically, the jaw wire connection portion 156*a* of the load jaw 150*a* is adapted to be connected to a first insulated wire, also referred to as a load wire 180. In certain embodiments, the jaw wire connection portion 156*a* is crimped, crushed, and/or soldered around a stripped portion of the load wire 180. According to some embodiments, a portion of the load wire 180 is stripped, the jaw wire connection portion 156*a* is crimped around the stripped portion, and the jaw wire connection portion 156*a* is dipped in molten solder. According to certain embodiments, the load wire 180 is electrically connected to the first jaw member 150*a* and electrically connected to the load pad 124 such as through the jaw wire connection portion 156*a*.

The jaw wire connection portion 156*b* of the volt jaw 150*b* is adapted to be connected with, or coupled to, a second insulated wire, also referred to as a volt wire 184. In certain embodiments, a stripped portion of the volt wire 184 is soldered to the jaw wire connection portion 156*b*. The volt wire 184 is electrically connected to the second jaw member 150*b* and electrically connected to the volt rod 128. Other methods suitable for attaching both the load wire 180 and the volt wire 184 are contemplated.

The load wire 180 is typically an insulated copper wire. According to some embodiments, it is contemplated that the load wire 180 is between a 0 and 12 gauge wire. According to some embodiments, the load wire 180 is between a 2 and 8 gauge wire. According to some embodiments, the volt wire 184 is also an insulated copper wire. According to some embodiments, it is contemplated that the volt wire 184 can be between a 12 and 24 gauge wire. According to some embodiments, the volt wire 184 is between a 16 and 20 gauge wire.

According to certain embodiments, the load wire 180 is connected to a testing/charging device 190. Similarly, the volt wire 184 is connected to the testing/measuring device 190. According to some embodiments, the testing/measuring device 190 is at least used to measure current and voltage of a battery coupled to the device 190 by a pair of battery clamps (e.g. two of battery clamp 100). According to certain embodiments, the testing/measuring device 190 applies a load to a battery to test the battery and determine the general condition of the battery. For example, the testing/measuring device 190 applies a load to a battery and determines if the battery is good, bad, or marginal. In certain embodiments, the testing/measuring device 190 can measure current levels between about ½ amp and about 800 amps. According to some embodiments, the testing/measuring device 190 can measure current levels between about 200 amps and about 800 amps. In certain embodiments, the testing/measuring device 190 can also charge a battery. In some of these embodiments, the testing/measuring device 190 can supply between a fraction of an amp (e.g. in the milliamp range) up to about 150 amps as the device charges a battery. In certain other embodiments, the testing/measuring device 190 can supply between a fraction of an amp (e.g. in the milliamp range) up to about 80 amps as the device charges a battery.

According to some embodiments, the load wire 180 is electrically insulated from the volt wire 184. When the testing/measuring device 190 applies a load on a battery, current is drawn from the battery through the load wire 180. If the load wire 180 is not electrically insulated from the volt wire 184, a significant amount of current can flow through the volt wire 184. The current flowing through the volt wire 184 can cause the volt wire 184 to heat up and possibly catch fire. Additionally, the current flowing through the volt wire 184 can cause inaccurate or incorrect readings of voltage differentials. Specifically, according to some embodiments, current flowing through the volt wire 184 can result in a voltage reading error up to, for example, about 2-3 volts.

According to certain embodiments, the first and second jaw members 150*a,b* are electrically insulated from each other and/or the first and second jaw handles 110*a,b*. According to some embodiments, the jaw handles 110*a,b* are formed from plastic or other non-conducting materials so as to assist in insulating the jaw members 150*a,b* from one another. It is contemplated that according to certain embodiments, the jaw handles 110*a,b* can be formed from a conducting material, but at the same time remain insulated from the jaw members 150*a,b*; similarly, the jaw members 150*a,b* can remain insulated from one another. For example, plastic or other non-conducting spacers can be placed between the jaw members 150*a,b* and the jaw handles 110*a,b*. Electrically insulating the jaw members 150*a,b* from the jaw handles 110*a,b* can reduce or eliminate a voltage reading error due to surplus current flowing through the volt wire 184.

Figure 4:
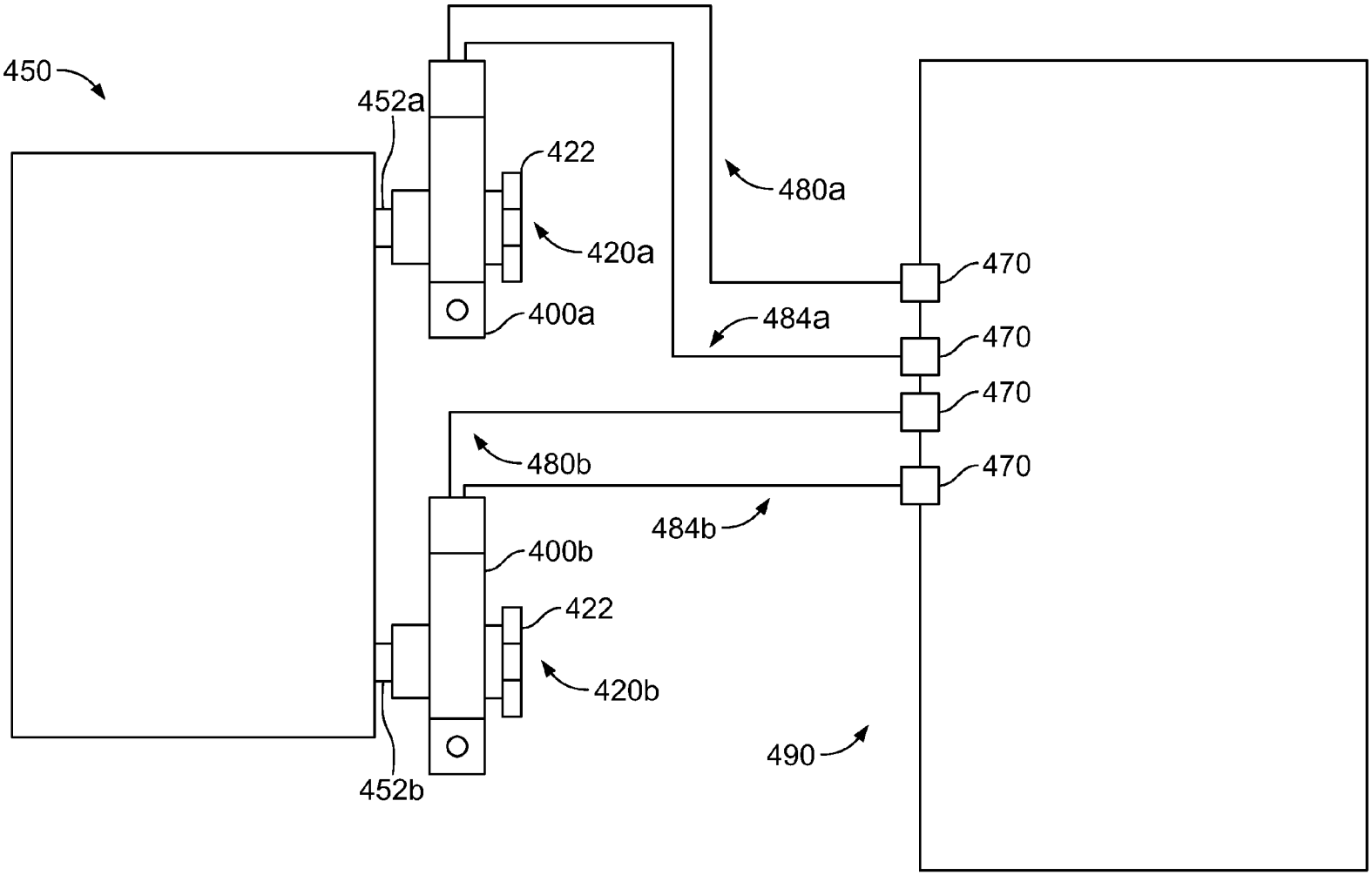
FIG. 4 is a schematic view of a pair of battery clamps coupled to a side post battery and to a testing and/or charging device according to some embodiments of the present disclosure.
Figure 5B:
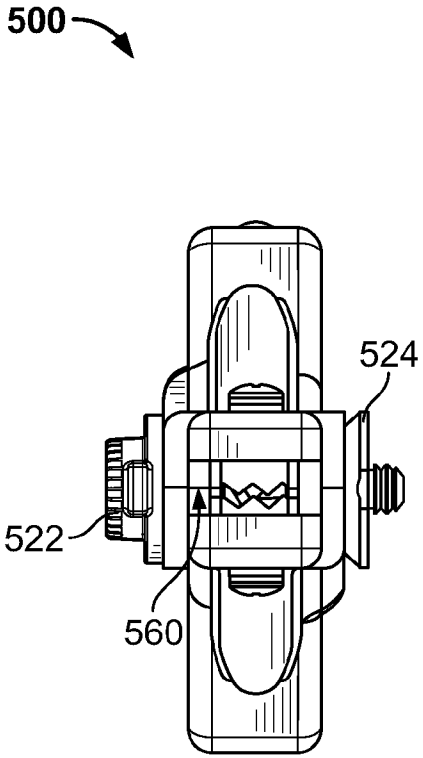
FIG. 5B is a front view of the battery clamp of FIG. 5A.
Figure 5A:
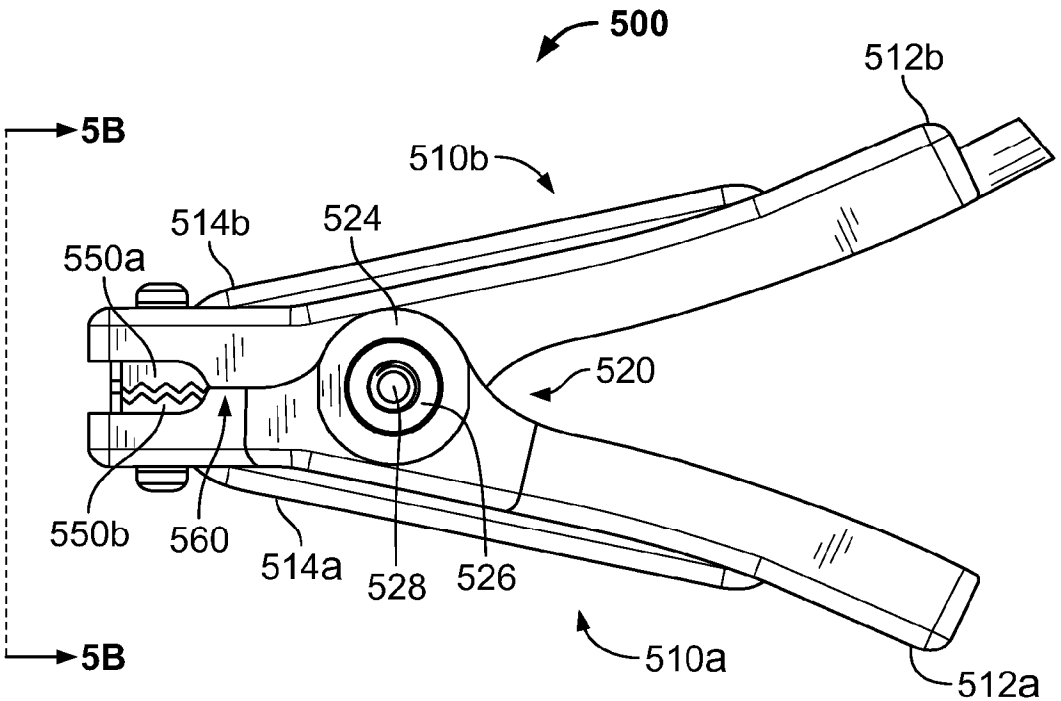
FIG. 5A is a side view of one side of a battery clamp according to some embodiments of the present disclosure.
Figure 5D:
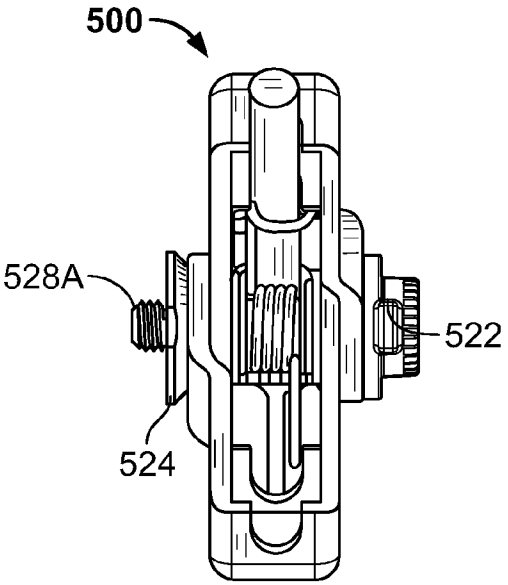
FIG. 5D is a rear view of the battery clamp of FIG. 5A.
Figure 5C:
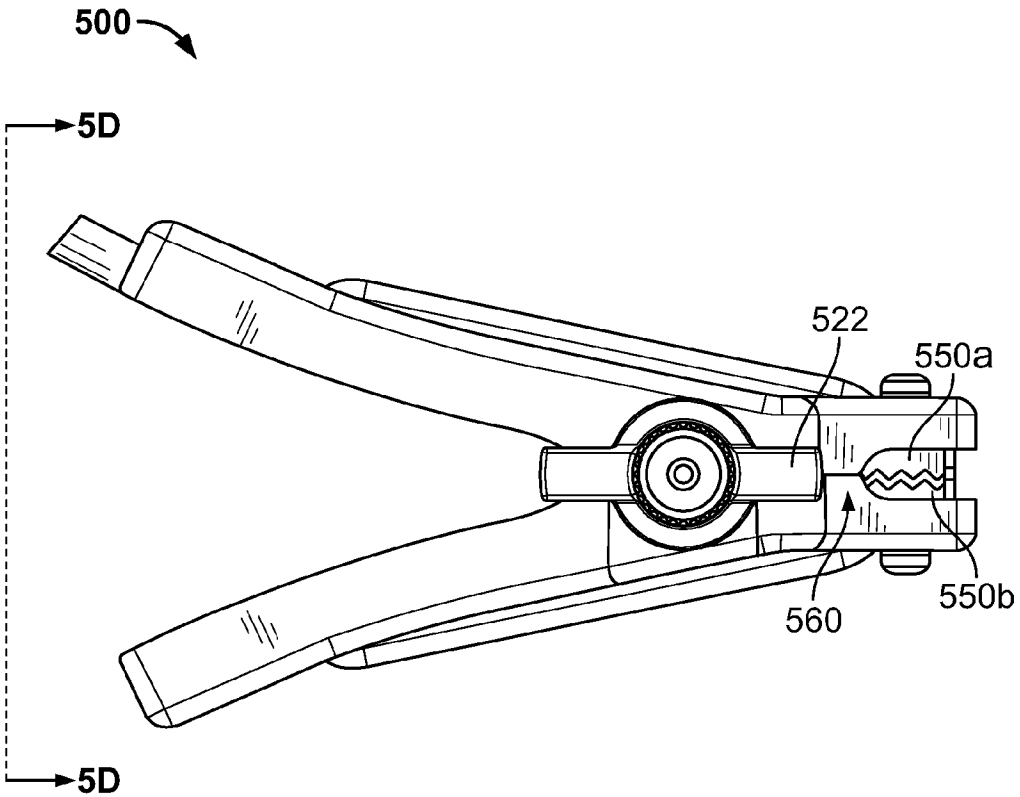
FIG. 5C is a side view of the other side of the battery clamp of FIG. 5A.

A full cycle of operation using a pair of battery clamps 400*a,b* to test and/or charge a side post terminal battery is now described. Referring to FIG. 4, a side post terminal battery 450 is shown having two side post terminals 452*a,b*. According to some embodiments, an operator or a technician connects a pair of battery clamps 400*a,b* to the side post terminals 452*a,b* of the battery 450. According to some embodiments, each of the battery clamps 400*a,b* include a side post adapter assembly 420*a,b*. To attach the battery clamps 400*a,b* via the side post adapter assemblies 420*a,b*, the operator places a first end of a volt rod, having a threaded end, (similar to the volt rod 128 shown in FIGS. 1A, 1C, 1D, and 1E) near the side post terminal 452*a*, for example. The operator then turns a handle 422 to screw the threaded end of the volt rod into a threaded bore of the side post terminal 452*a*. The operator continues to turn the handle 422 to thereby tighten the battery clamp 400*a* into the side post terminal 452*a*. By sufficiently turning the handle 422, the operator is able to cause a load pad (similar to the load pad 124 shown in FIGS. 1E and 1G) too firmly abut a lead pad of the side post terminal battery 450. The firm abutment of the load pad of the battery clamp with the lead pad of the battery 450 facilitates a good electrical connection thereby between which, in turn, facilitates more accurate readings of the battery 450 and better charging of the battery 450. The operator then does the same for the other battery clamp 400*b*. The battery clamps 400*a,b* now electrically connect the battery 450 to a device 490 via electrical cables attached to the battery clamps 400*a,b*. It is contemplated that according to some embodiments, the device 490 can be any one of, or any combination of, a testing device, a metering device, a charging device, a load device, and/or a frequency device. Specifically, a load wire 480*a,b*, and a volt wire 484*a,b* electrically connects each of the battery clamps 400*a,b* to the device 490. According to some embodiments, the load wires 480*a,b* and the volt wires 484*a,b* are connected to plurality of wire terminals 470. According to certain embodiments, the load wires 480*a,b* are connected to two wire terminals 470 and the volt wires 484*a,b* are connected to two other wire terminals 470. It is contemplated that according to some embodiments, the load wires 480*a,b* and the volt wires 484*a,b* connect to the device 490 via a threaded connection, a loop coupler connection, an I-coupler connection, a bolt connection, a screw connection, and/or a solder connection. According to certain embodiments, the ends of the electrical wires are stripped and a loop coupler is crimped, crushed, and soldered to the wire. The loop coupler is then attached to the device 490 via a screw or bolt connection. Other methods of connecting electrical wire to a device are contemplated as known in the battery testing/charging art. Once the battery clamps 400*a,b* are attached to the battery 450, the operator can either charge or perform a test on the battery using the device 490.

It is contemplated that the battery clamps 400*a,b* can likewise be attached to a top post battery to perform a test or charge of a top post battery. In such a testing/charging situation, an operator squeezes the jaw handles of the battery clamps 400*a,b* together opening the jaws and attaches them to a respective top post terminal. According to some embodiments, the device 490 is configured to let an operator know if a jaw member is not properly coupled to a battery being testing and/or charged. For example, if the jaw members of a battery clamp are not properly attached to the battery, the testing/measuring device can be configured to produce an error code. It is contemplated that according to some embodiments, the error code can be, for example, an audible sound and/or a visual error message displayed to the operator on an attached display. It is also contemplated that the device 490 can be configured to produce such error indications when side post adapters are used to connect the battery clamps to a side post battery.

Referring to FIGS. 5A-D, a battery clamp 500 for testing and/or charging both batteries with top post terminal connections and batteries with side post terminal connections is depicted according to some embodiments. The battery clamp 500 includes a first jaw handle 510*a*, a second jaw handle 510*b*, a first jaw member 550*a*, a second jaw member 550*b*, and a side post adapter assembly 520. The first and second jaw handles 510*a,b* each have a handle portion 512*a,b* and a clamping portion 514*a,b*. The first and second jaw members 550*a,b* include a jaw clamp portion, a jaw pivot portion, and a jaw wire connection portion, similar to the first and second jaw members 150*a,b* described above. The side post adapter assembly 520 includes a handle 522, a load pad 524, an insulating member 526, and a volt rod 528. The volt rod 528 generally has the shape of a cylinder with two opposing ends. The first opposing end includes a threaded portion 528*a*. The battery clamp 500 is configured to work with a testing and/or charging device in a similar manner as the battery clamp 100 is described above.

Figure 6:
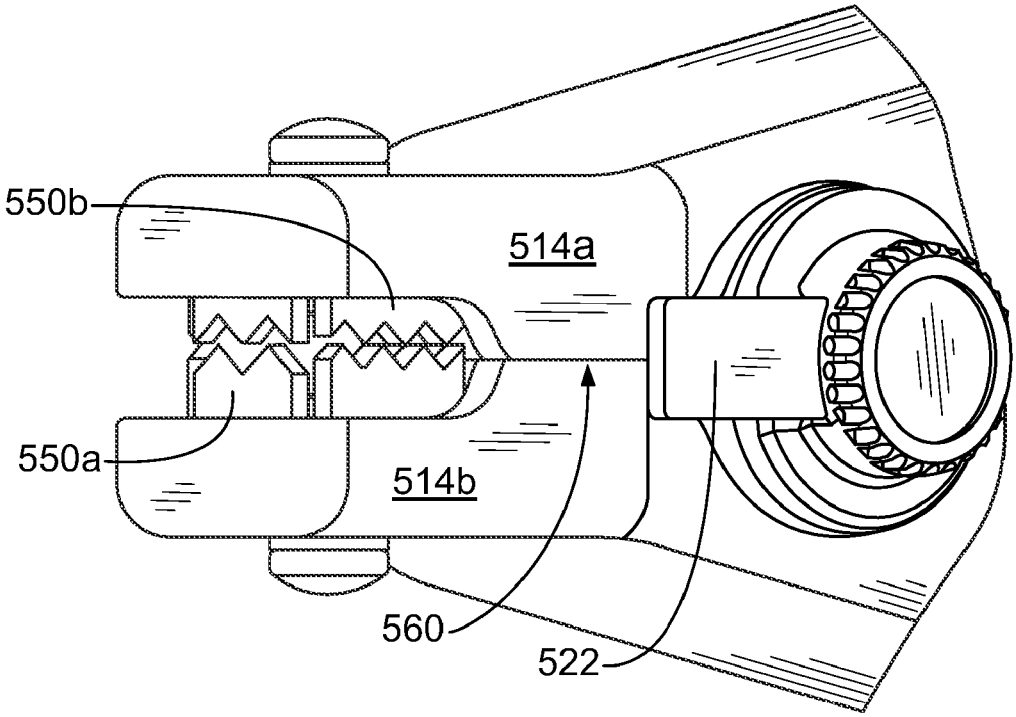
FIG. 6 is an enlarged perspective view of the front portion of the battery clamp of FIG. 5*a;*

According to some embodiments, the jaw handles 510*a,b* further include at least one stopping mechanism 560. According to some embodiments, the at least one stopping mechanism 560 prevents the jaw clamp portions of the jaw members 550*a,b* from touching when the jaw handles 510*a,b* are biased in a closed position. It is contemplated that the at least one stopping mechanism 560 can be formed as a part of at least one of the jaw handles 510*a,b*. For example, the at least one stopping mechanism 560 can be a tab of material located on or near the clamping portion 514*a* of the first jaw handle 510*a*. Similarly, the at least one stopping mechanism 560 can be a tab of material located on both jaw handles 510*a,b* such that when the battery clamp 500 is in the closed position, the tab on the first jaw handle 510*a* mates with a tab on the second jaw handle 510*b*. For example, FIG. 6 shows an enlarged view of the clamping portions 514*a,b* of battery clamp 500 having the stopping mechanism 560 built into the jaw handles 510*a,b*. The jaw handles 510*a,b* are in the closed position, yet the built-in stopping mechanism 560 prevents the first jaw member 550*a* from contacting the second jaw member 550*b*.

Now turning to FIGS. 8A-G, a battery clamp 800 for testing and charging both batteries with top post terminal connections and batteries with side post terminal connections is shown according to some embodiments. According to some embodiments, the battery clamp 800 can measure current from about 0 amps to about 40 amps. According to some embodiments, the battery clamp 800 can measure current levels on the order of milliamps.

Figure 8A:
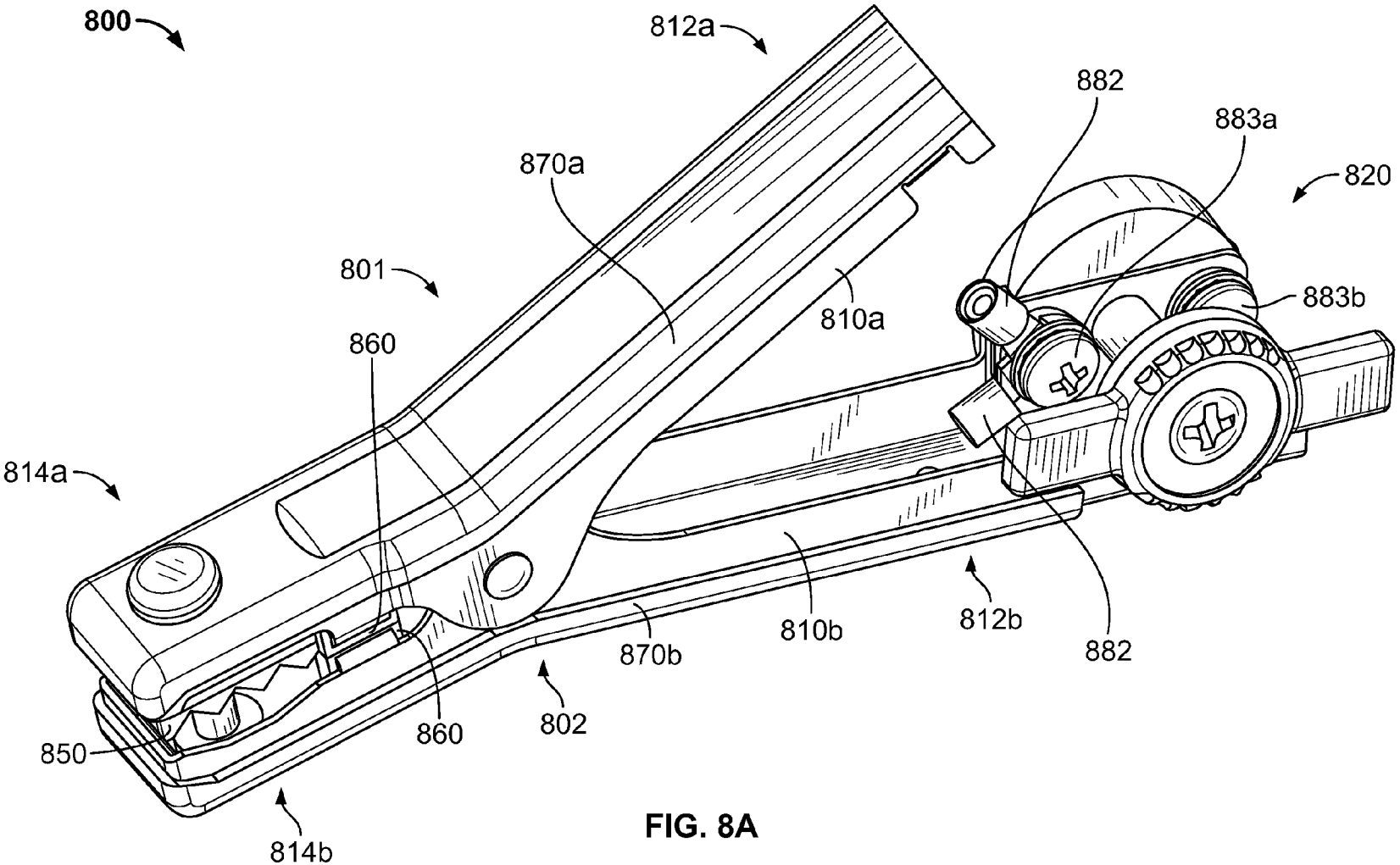
FIG. 8A is a perspective view of a battery clamp according to some embodiments of the present disclosure.
Figure 8B:
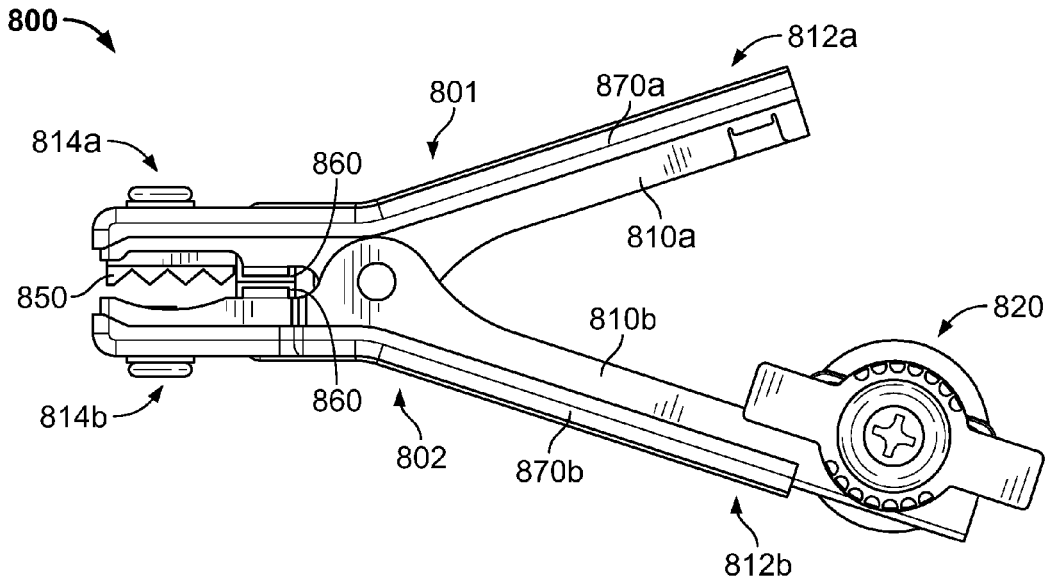
FIG. 8B is a side view of one side of the battery clamp of FIG. 8A.
Figure 8C:
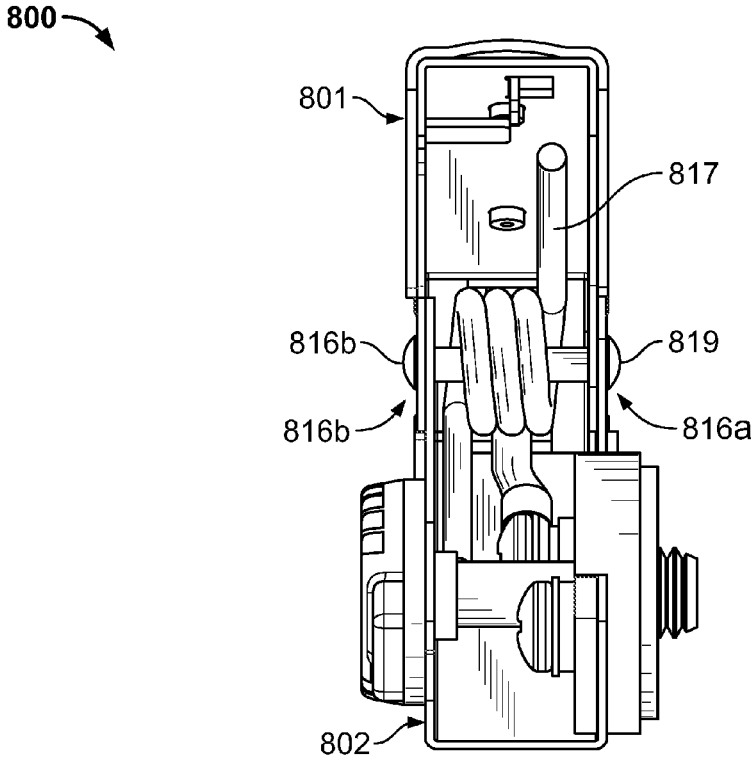
FIG. 8C is a rear view of the battery clamp of FIG. 8A.
Figure 8D:
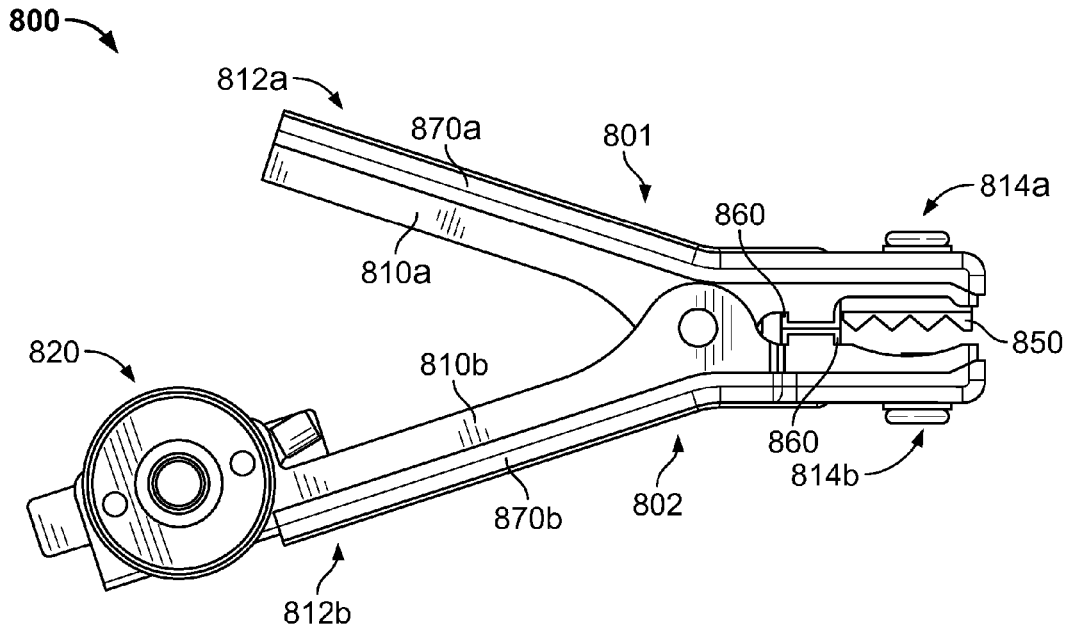
FIG. 8D is a side view of the other side of the battery clamp of FIG. 8A.

Referring to FIGS. 8A, 8B, and 8D, the battery clamp 800 includes a load handle assembly 801, a volt handle assembly 802, and a side post adapter assembly 820. The load handle assembly 801 includes a first jaw handle 810*a*, a first jaw handle cover 870*a*, and a jaw member 850. The volt handle assembly 802 includes a second jaw handle 810*b* and a second jaw handle cover 870*b*. Both the load handle assembly 801 and the volt handle assembly 802 have a handle portion 812*a,b* and a clamping portion 814*a,b*. It is contemplated that according to some embodiments, the volt handle assembly 802 can further include a jaw member similar to, or the same as, the jaw member 850.

According to some embodiments, the first and second jaw handles 810*a,b* and the jaw member 850 can be formed from a variety of electrically conductive materials including, but not limited to, steel, carbon, copper, iron, aluminum, and combinations thereof. According to some embodiments, the first and second jaw handles 810*a,b* are formed from copper-plated steel and the jaw member 850 is formed from copper.

Figure 8E:
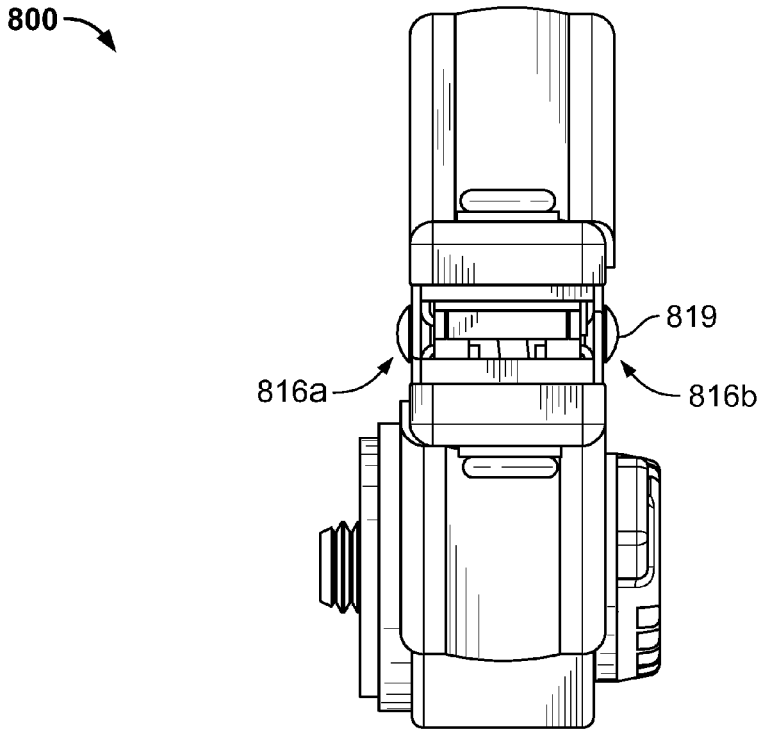
FIG. 8E is a front view of the battery clamp of FIG. 8A.
Figure 8F:
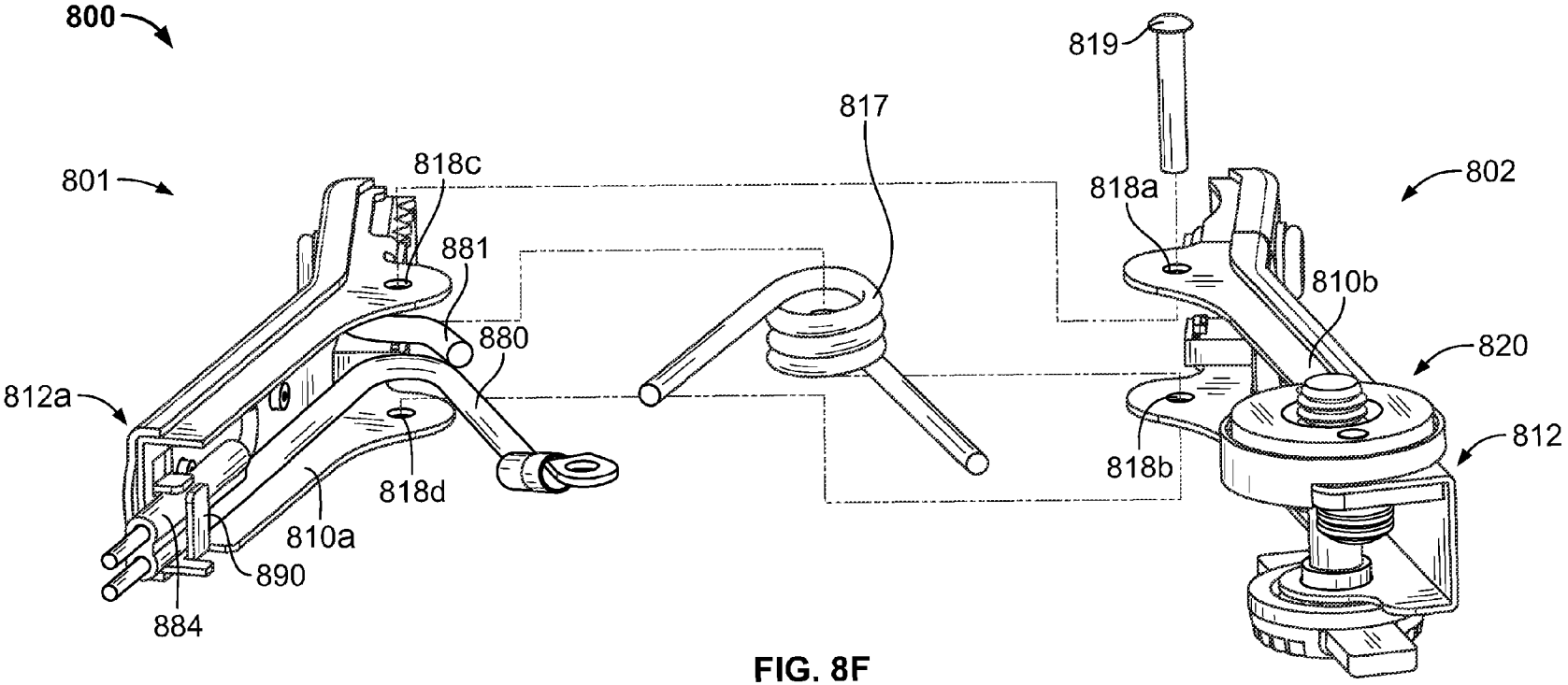
FIG. 8F is a partial exploded view of the battery clamp of FIG. 8A.

Referring to FIG. 8F, a partial exploded view of the battery clamp 800 is shown. According to some embodiments, the first and second jaw handles 810*a,b* are substantially the same. According to some embodiments, the second jaw handle 810*b* has a longer handle portion 812*b* to accommodate attachment of the side post adapter assembly 820. According to some such embodiments, additional apertures may be included to facilitate attachment of the side post adapter assembly 820. Other methods of attaching the side post adapter assembly 820 are contemplated. According to some embodiments, the first and the second jaw handles 810*a,b* each include at least two apertures. The second jaw handle 810*b* includes a first aperture 818*a* and a second aperture 818*b*, and the first jaw handle 810*a* includes a third aperture 818*c* and a fourth aperture 818*d*. According to some embodiments, when the first jaw handle 810*a* is attached or coupled to the second jaw handle 810*b*, the first and the third apertures 818*a,c* are aligned with each other to form a first pivot point 816*a*, as shown in FIGS. 8C and 8E. Similarly, according to some embodiments, the second and the fourth apertures 818*b,d* are aligned to form a second pivot point 816*b*, also shown in FIGS. 8C and 8E and described above.

Referring to FIGS. 8A-E, according to some embodiments, the load handle assembly 801 and the volt handle assembly 802 are pivotally connected via a pivot pin 819, which connects to the load and volt handle assemblies 801, 802 through first and second pivot points 816*a,b*. According to some embodiments, the pivot pin 819 can be a rivet, a screw, a bolt, a pin, etc. According to some embodiments, the pivot pin 819 can maintain the relative position of a biasing member 817 between the load handle assembly 801 and the volt handle assembly 802, as shown in FIG. 8C. According to some embodiments, the biasing member 817 biases the battery clamp 800 in a closed position or a substantially closed position, with the clamping portions 814*a,b* in a near touching position.

According to some embodiments, the pivot pin 819 aids in electrically coupling the first and second jaw handles 810*a,b*. According to some embodiments, when conducting a test of a side post battery using the side post adapter assembly 820, the clamping portion 814*b* of the second jaw handle 810*b* is spaced away from the jaw member 850, which is attached to the clamping portion 814*a* of the first jaw handle 810*a*.

According to some embodiments, a stopping mechanism 860 (shown in FIGS. 8A, 8B, 8D, 8G, and 8H) prevents the jaw member 850 from physically touching the clamping portion 814*b* of the second jaw handle 810*b*. According to some embodiments, the stopping mechanism 860 can include one or more spacers attached to the first and second jaw handles 810*a,b*. In these embodiments, when the first and second jaw handles 810*a,b* are in the substantially closed position, the spacer(s) of the first jaw handle 810*a* oppose the spacer(s) of the second jaw handle 810*b*, thereby preventing the physical touching of the jaw member 850 and the clamping portion 814*b* of the second jaw handle 810*b*. It is contemplated that the stopping mechanism 860 can be formed from any of a variety of materials including, but not limited to, steel, carbon, copper, iron, aluminum, plastic, rubber, and combinations thereof.

According to some embodiments, preventing the jaw member 850 from touching the clamping portion 814*b* can yield more accurate testing results. According to some embodiments, the accuracy of the testing results can increase when taking electrically separate amperage measurements and electrically separate voltage measurements. During a test of a battery using the side post adapter assembly 820, such electrically separate measurements can be accomplished by keeping the jaw member 850, which is insulated from the first jaw handle 810*a*, from touching the clamping portion 814*b* of the second jaw handle 810*b*. As will become more apparent from the discussion below regarding the load handle assembly 801, the jaw member 850 is insulated from the first jaw handle 810*a*. Thus, according to some embodiments, when using a pair of battery clamps, as shown in FIG. 4, to measure and/or test a side post battery (e.g., battery 450), a voltage potential can be measured across the jaw handles 810*a,b* of a first battery clamp and the jaw handles 810*a,b* of a second battery clamp, while the jaw members 850 of each of the battery clamps can simultaneously conduct current to a testing/charging device (e.g., testing/charging device 190, 490).

According to some embodiments, an operator can use the battery clamp 800 to test and/or charge a top post battery by squeezing the handle portions 812*a,b* of the load and volt handle assemblies 801, 802 together in a similar manner as battery clamp 100, described above. The biasing member 817 is thereby compressed and the clamping portions 814*a,b* are further separated. The operator can then place the separated clamping portions 814*a,b* around a top post of the top post battery and/or a battery cable connector attached to the top post and release the handle portions 812*a,b* thereby allowing the battery clamp 800 to "clamp" onto the top post and/or the battery cable connector. Testing and/or charging of the top post battery may follow.

Referring back to FIGS. 8A and 8F, the battery clamp 800 receives electrical wires that electrically couple the battery clamp 800 to, for example, a testing/charging device, that is the same as, or similar to, the testing/charging device 190 shown in FIG. 1F and described above. According to some embodiments, a load wire 880 (shown in FIGS. 8F and 8H) and a volt wire 884 are generally attached to the battery clamp 800 by crimping a portion 890 of the first jaw handle 810*a* around the wires 880,884. Specifically, the handle portion 812*a* of the load handle assembly 801 receives the load wire 880 and the volt wire 884, which are similar to the load wire 180 and the volt wire 184 shown in FIG. 1F and described above. According to some embodiments, the volt wire 884 is electrically coupled with the first jaw handle 810*a*. According to other embodiments, the volt wire 884 can be positioned or bent around the biasing member 817 and electrically coupled with the second jaw handle 810*b*, as both the first and second jaw handles 810*a,b* are electrically coupled.

According to some embodiments, the load wire 880 is positioned or bent around the biasing member 817 and electrically coupled with the side post adapter assembly 820 (described in further detail below). Additionally, the jaw member 850 is electrically coupled with the side post adapter assembly 820 via a load jumper wire 881 (also described in further detail below). According to some embodiments, the load jumper wire 881 is electrically coupled to the jaw member 850 and electrically coupled to the load wire 880.

The load wire 880, the volt wire 884, and the load jumper wire 881 are typically insulated copper wire. According to some embodiments, it is contemplated that the load wire 880 is between about a 10 to about a 18 gauge wire. According to some embodiments, the load wire 880 is between about a 12 to about a 16 gauge wire. According to some embodiments, it is contemplated that the volt wire 884 can be between about a 10 to about a 18 gauge wire. According to some embodiments, the volt wire 884 is between about a 12 to about a 16 gauge wire. According to some embodiments, the load jumper wire 881 is between about a 10 to about a 18 gauge wire. According to some embodiments, the load jumper wire 881 is between about a 12 to about a 16 gauge wire.

Figure 8G:
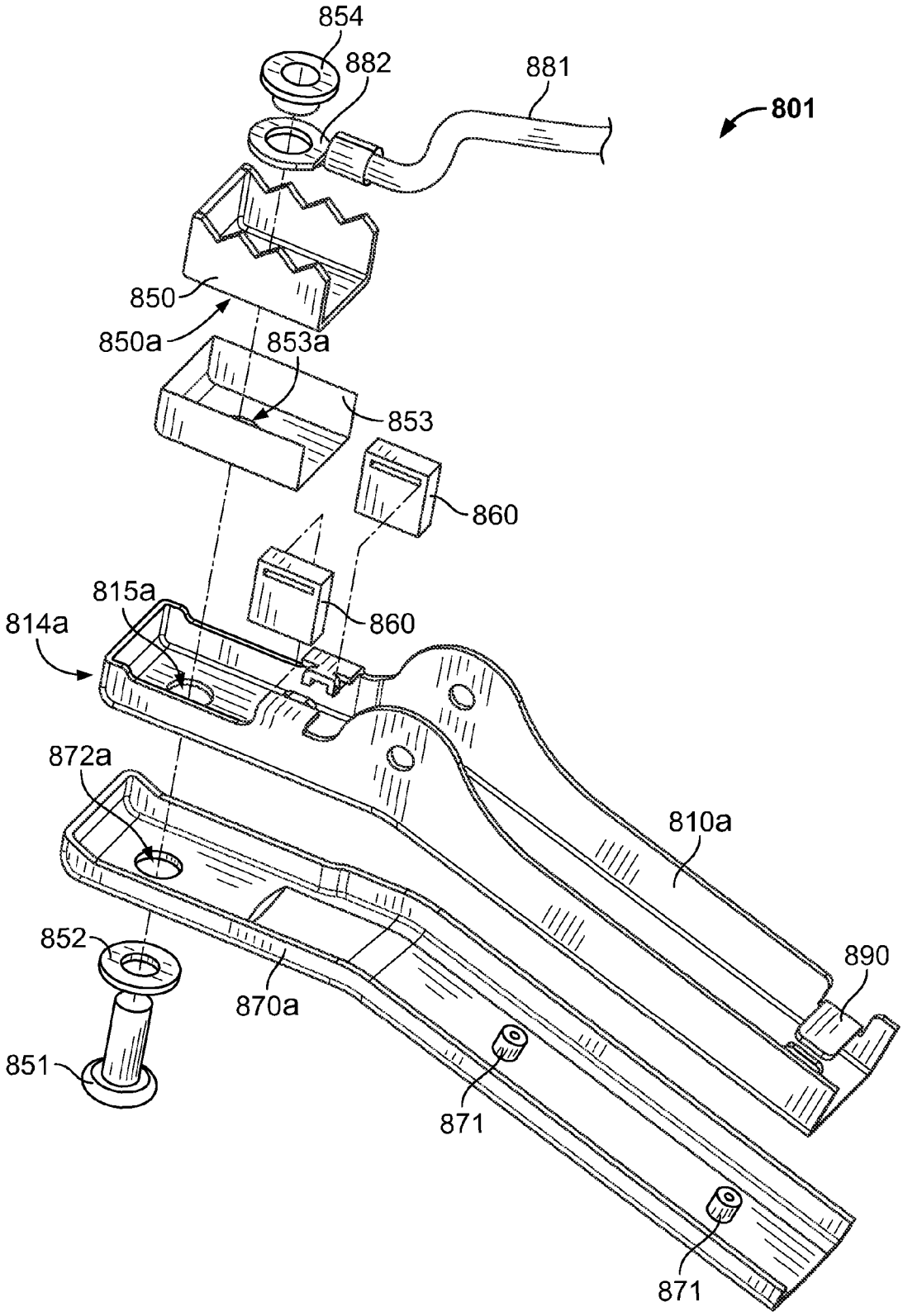
FIG. 8G is an exploded view of a load handle assembly of the battery clamp of FIG. 8A according to some embodiments.

Now referring to FIG. 8G, an exploded view of the load handle assembly 801 is shown according to some embodiments. The load handle assembly 801 includes the first jaw handle 810*a*, the first jaw handle cover 870*a*, and the jaw member 850. According to some embodiments, the first jaw handle cover 870*a* is press fit onto the first jaw handle 810*a*. The first jaw handle cover 870*a* can include one or more tabs 871 that can be press fit into one or more respective apertures (not shown) in the first jaw handle 810*a*. Other methods of attaching the first jaw handle cover 870*a* are contemplated. For example, the first jaw handle cover 870*a* can be attached to the jaw handle 810*a* via a glue connection, a heat stake connection, a solder connection, a press fit connection, a screw connection, a rivet connection, etc.

According to some embodiments, the first and second jaw handle covers 870*a,b* can both be formed from a variety of insulating materials including, but not limited to, plastic and rubber. According to some embodiments, the first jaw handle cover 870*a* and the first jaw handle 810*a* each include an aperture 872*a*, 815*a*, respectively, for receiving a rivet 851. According to some embodiments, the rivet 851 aids in attaching the first jaw handle cover 870*a* to the first jaw handle 810*a*. A washer 852 may be provided between the rivet 851 and the first jaw handle cover 870*a*.

According to some embodiments, a jaw member insulator 853 is provided to electrically insulate the jaw member 850 from the first jaw handle 810*a*. It is contemplated that the jaw member insulator 853 may be formed in various shapes and from various insulating materials. According to some embodiments, the jaw member insulator 853 is an insulating sleeve that covers an exterior surface area of the jaw member 850. According to some embodiments, the jaw member insulator 853 includes an aperture 853*a*, similar in size to apertures 872*a* and 815*a*, to receive the rivet 851. According to some embodiments, the jaw member 850 fits into or is pressed into the jaw member insulator 853. The jaw member 850 similarly has an aperture 850*a* that is aligned with aperture 853*a* to receive the rivet 851.

According to some embodiments, the load jumper wire 881 is physically and electrically coupled to the jaw member 850 by the rivet 851. According to some embodiments, the rivet 851 fits through the washer 852, then through apertures 872*a*, 815*a*, 853*a*, and 850*a*, then through a wire ring terminal 882, and then through an insulating step washer 854. The rivet 851 maintains the load jumper wire 881 in electrical contact with the jaw member 850 via, for example, the wire ring terminal 882, while the jaw member insulator 853 and the insulating step washer 854 keep the jaw member 850 electrically insulated from the first jaw handle 810*a*.

According to some embodiments, the load handle assembly 801 does not include the rivet 851. For example, the first jaw handle cover 870*a* can be press fit onto the first jaw handle 810*a*, the jaw member insulator 853 can be press fit into the clamping portion 814*a* of the first jaw member 810*a*, the jaw member 850 can be press fit into the jaw member insulator 853, and the load jumper wire 881 can be soldered onto the jaw member 850. Various other methods of connecting the above described parts are contemplated such that the jaw member 850 is electrically insulated from the first jaw handle 810*a* and the load jumper wire 881 is electrically coupled to the jaw member 850.

Figure 8H:
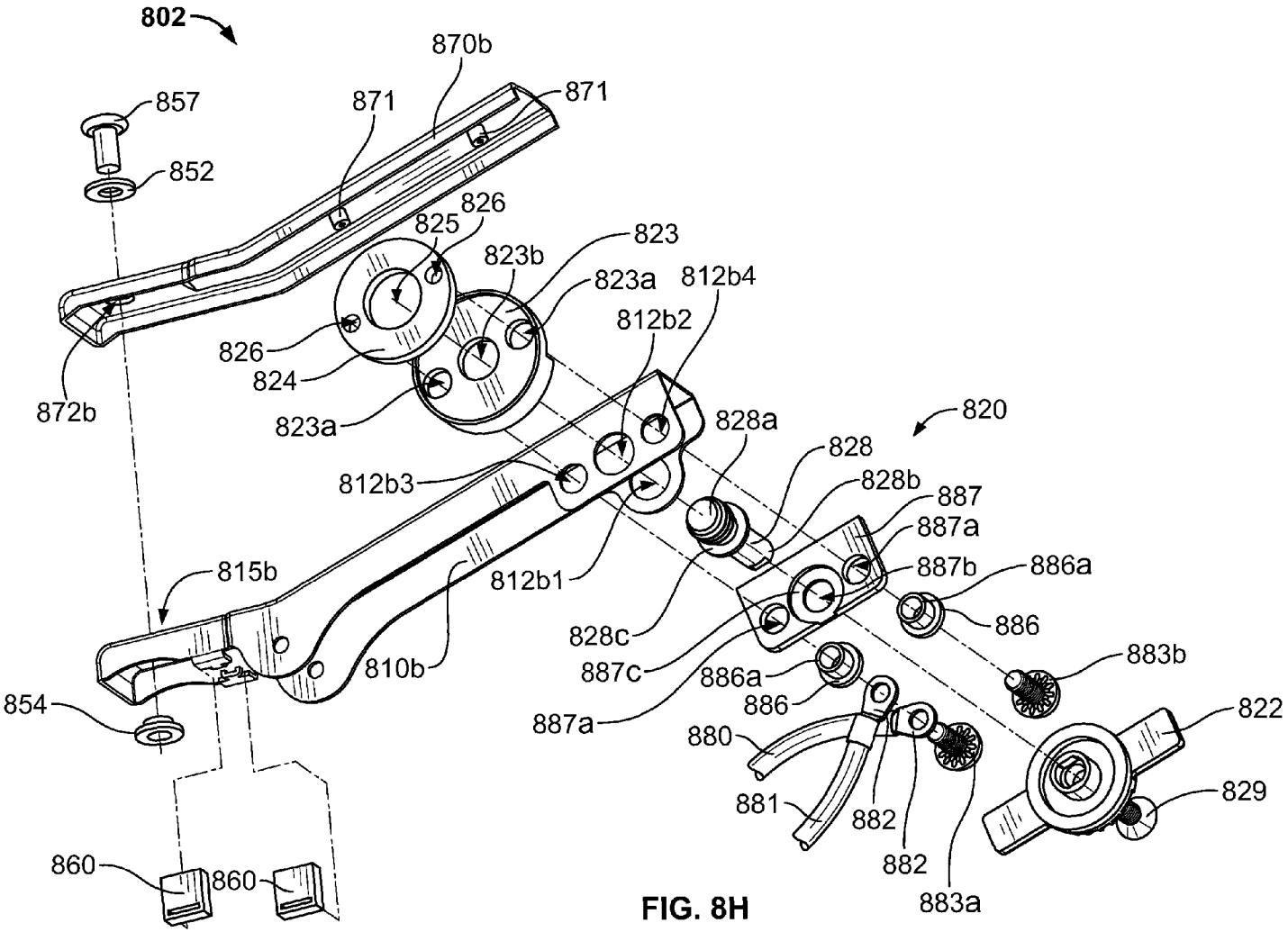
FIG. 8H is an exploded view of a volt handle assembly of the battery clamp of FIG. 8A according to some embodiments.

Now referring to FIG. 8H, an exploded view of the volt handle assembly 802 and the side post adapter assembly 820 is shown according to some embodiments. The volt handle assembly 802 includes the second jaw handle 810*b* and the second jaw handle cover 870*b*. The second jaw handle cover 870*b* is connected with the second jaw handle 810*b* in the same, or similar, manner as the first jaw handle cover 870*a* is connected with the first jaw handle 810*a* as described above. Similar to the first jaw handle cover 870*a* described above, the second jaw handle cover 870*b* can include one or more tabs 871.

According to some embodiments, the second jaw handle cover 870*b* and the second jaw handle 810*b* each include an aperture 872*b*, 815*b*, respectively, for receiving a rivet 857. According to some embodiments, the rivet 857 aids in attaching the second jaw handle cover 870*b* to the second jaw handle 810*b*. A washer 852 may be provided between the rivet 857 and the second jaw handle cover 870*b*. According to some embodiments, the rivet 857 fits through the washer 852, then through apertures 872*b*, 815*b*, and then through the insulating step washer 854. It is contemplated that the volt handle assembly 802 can be provided without the rivet 857, the washer 852, and the insulating step washer 854. In these embodiments, the second jaw handle cover 870*b* is otherwise sufficiently attached to the second jaw handle 810*b*. Other methods of attaching the second jaw handle cover 870*b* are contemplated. For example, the second jaw handle cover 870*b* can be attached to the jaw handle 810*b* via a glue connection, a solder connection, a heat stake connection, a press fit connection, a screw connection, a rivet connection, etc. According to some embodiments, the volt handle assembly 802 can further include a jaw member that is attached to the second jaw handle 810*b* in the same, or similar, manner as jaw member 850 is attached to the first jaw handle 810*a*.

According to some embodiments, the side post adapter assembly 820 includes a handle 822, an insulating plate 887, a volt rod 828, an insulating disk 823, and a load pad 824. The handle 822 is similar to and operates in a similar manner as the handle 122 shown in FIGS. 1B-E and described above in relation to battery clamp 100. The volt rod 828 is similar to and operates in a similar manner as the volt rod 128 shown in FIG. 1E and described above in relation to battery clamp 100. The load pad 824 is similar to and operates in a similar manner as the load pad 124 shown in FIGS. 1E and 1G and described above in relation to battery clamp 100.

According to some embodiments, the volt rod 828 has a threaded end 828*a* and a second opposing end 828*b*. The threaded end 828*a* includes a flange 828*c*. According to some embodiments, the threaded end 828*a* is positioned through a first handle aperture 812*b*1 and a second handle aperture 812*b*2 such that the flange 828*c* is physically and electrically coupled with the second jaw handle 810*b*. The threaded end 828*a* also protrudes through aperture 823*b* in the insulating disk 823 and through aperture 825 in the load pad 824 such that the threaded end 828*a* can be coupled with a side post terminal of a side post battery in a similar manner as battery clamps 400*a,b*, as shown in FIG. 4 and described above.

According to some embodiments, the insulating disk 823 electrically insulates the load pad 824 from the second jaw handle 810*b*. According to some embodiments, the insulating disk 823 and the load pad 824 are coupled to the second jaw handle 810*b* by screws 883*a,b*. According to some embodiments, the second opposing end 828*b* of the volt rod 828 is positioned through aperture 887*b* of the insulating plate 887. According to some embodiments, the insulating plate 887 can include a recess 887*c* that engages the flange 828*c* of the volt rod 828, thereby assisting in forming an electrical connection between the volt rod 828 and the second jaw handle 810*b*. According to some embodiments, the insulating plate 887 also includes apertures 887*a* to receive insulating bushings 886. The insulating bushings 886 have extended sleeve portions 886*a* that fit through apertures 887*a*; apertures 812*b*3 and 812*b*4; and apertures 823*a* so as to electrically insulate the second jaw handle 810*b* from screws 883*a,b*.

According to some embodiments, the screws 883*a,b* physically couple the side post adapter assembly 820 to the second jaw handle 810*b*. According to some embodiments, the screws 883*a,b* electrically couple the load wire 880 and/or the load jumper wire 881 with the load pad 824. According to some embodiments, the ends of the load wire 880 and of the load jumper wire 881 are stripped and attached and/or soldered to a respective wire ring terminal 882, which are shown in FIGS. 8A and 8H. Other methods of coupling the wires to the side post adapter assembly 820 are contemplated.

According to some embodiments, one of the screws 883*a* attaches the wire ring terminal 882 of the load wire 880 and the wire ring terminal 882 of the load jumper wire 881 to the side post adapter assembly 820, as shown in FIG. 8H. According to other embodiments, one of the screws (e.g., screw 883*a*) attaches the wire ring terminal 882 of the load wire 880 to the side post adapter assembly 820, and the other screw (e.g., screw 883*b*) attaches the wire ring terminal 882 of the load jumper wire 881 to the side post adapter assembly 820.

Once the screws 883 are positioned through the wire ring terminal(s), the screws 883 can be positioned through the insulating bushings 886, which as described above electrically insulate the screws 883 from the second jaw handle 810*b*. The screws 883 are long enough to pass through the insulator bushings 886 and into threaded apertures 826. The screws 883 mesh with, or grip, the threads of threaded apertures 826, thereby coupling the load wire 880, the load jumper wire 881, the insulating bushings 886, the insulating plate 887, the volt rod 828, the insulating disk 823, and the load pad 824 onto the handle portion 812*b* of the second jaw handle 810*b*. According to some embodiments, the side post adapter assembly 820 can be similarly coupled onto the handle portion 812*a* of the first jaw handle 810*a*.

According to some embodiments, the second opposing end 828*b* of the volt rod 828 protrudes through the aperture 887*b* and through the aperture 812*b*1 such that the second opposing end 828*b* can be inserted into the handle 822. The handle 822 is the same as, or similar to, the handle 122 shown in FIGS. 1B-E and described above. According to some embodiments, the handle 822 is secured onto the second opposing end 828*b* with a screw 829. Other methods of fastening the handle 822 onto the volt rod 828 are contemplated.

As described above, the insulator bushings 886, the insulator plate 887, and the insulating disk 823 all serve to electrically insulate the volt rod 828 from the load pad 824. Additionally, the jaw member insulator 853 serves to electrically insulate the jaw member 850 from the first and second jaw handles 810*a,b* and the volt rod 828. Thus, the volt rod 828 and the first and second jaw handles 810*a,b* are electrically coupled such that when using a pair of battery clamps, as shown in FIG. 4, to measure and/or test a side post battery (e.g., battery 450), a voltage potential can be measured across the volt rod 828 or the jaw handles 810*a,b* of a first battery clamp and the volt rod 828 or the jaw handles 810*a,b* of a second battery clamp, while the load pads 824 or the jaw members 850 of each of the battery clamps can simultaneously conduct current to a testing/charging device (e.g., testing/charging device 190, 490).

According to certain embodiments, FIGS. 9A-E depict a battery clamp 900 for testing and charging batteries with top post terminal connections and batteries with side post terminal connections. The battery clamp 900 includes a first jaw handle 910*a*, a second jaw handle 910*b*, a first jaw member 950*a*, a second jaw member 950*b*, and a side post adapter assembly 920. The first and second jaw handles 910*a,b* each have a handle portion 912*a,b* and a clamping portion 914*a,b*. According to some embodiments, the first and the second jaw handles 910*a,b* is the same as or similar to the first and the second jaw handles 110*a,b* described above in reference to battery clamp 100.

Figure 9A:
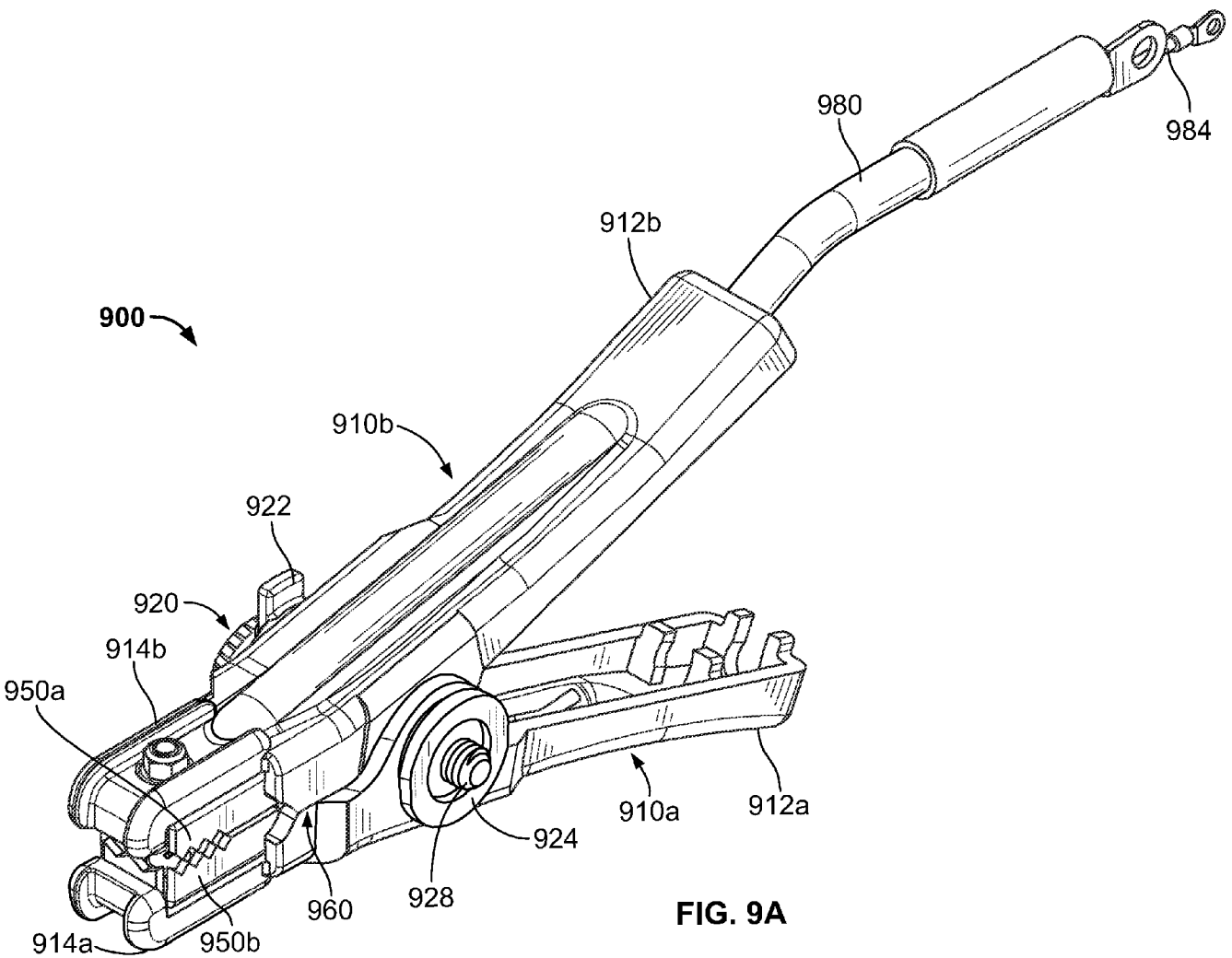
FIG. 9A is a perspective view of a battery clamp according to some embodiments of the present disclosure.
Figure 9B:
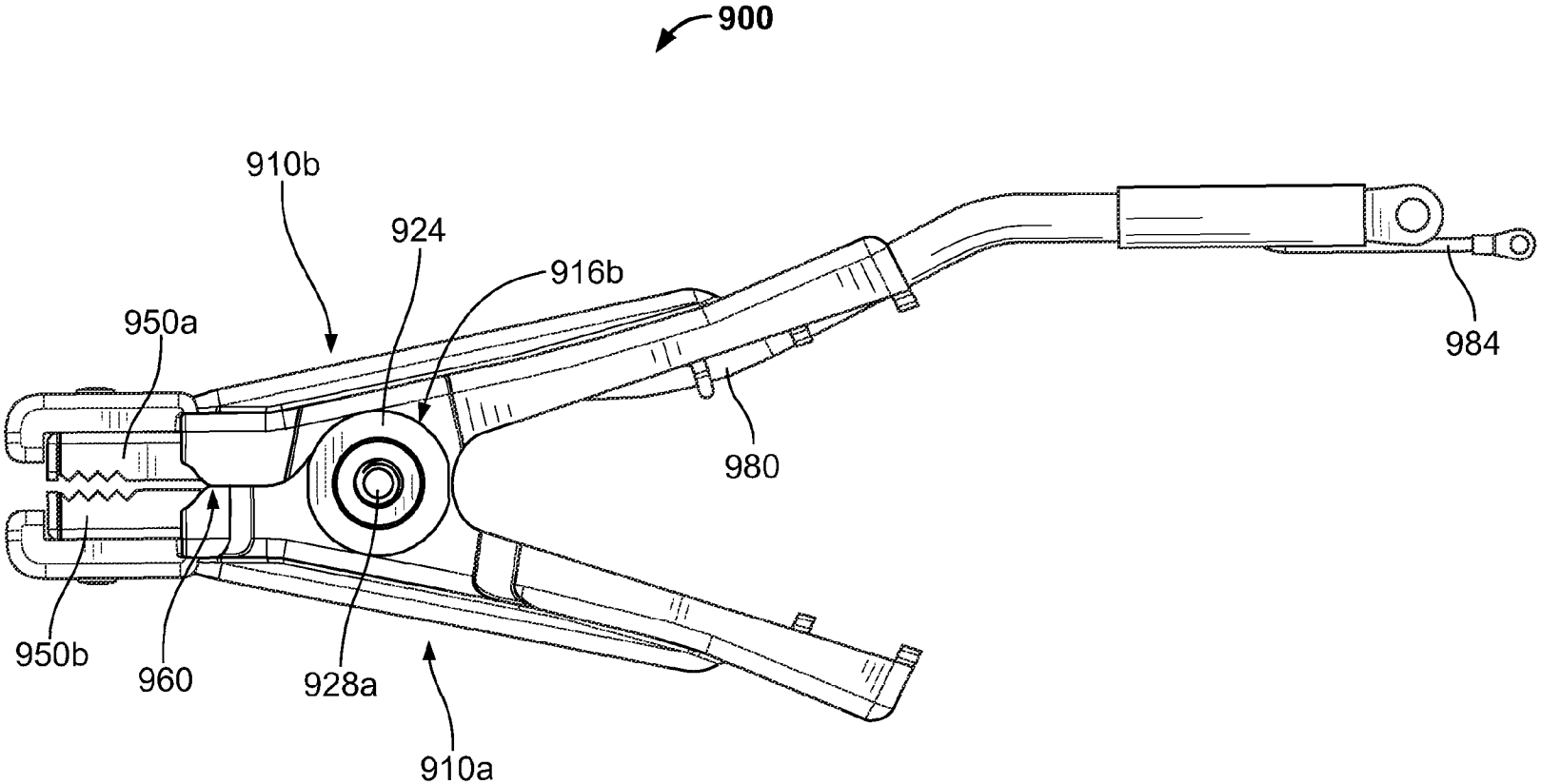
FIG. 9B is a side view of one side of the battery clamp of FIG. 9A.
Figure 9C:
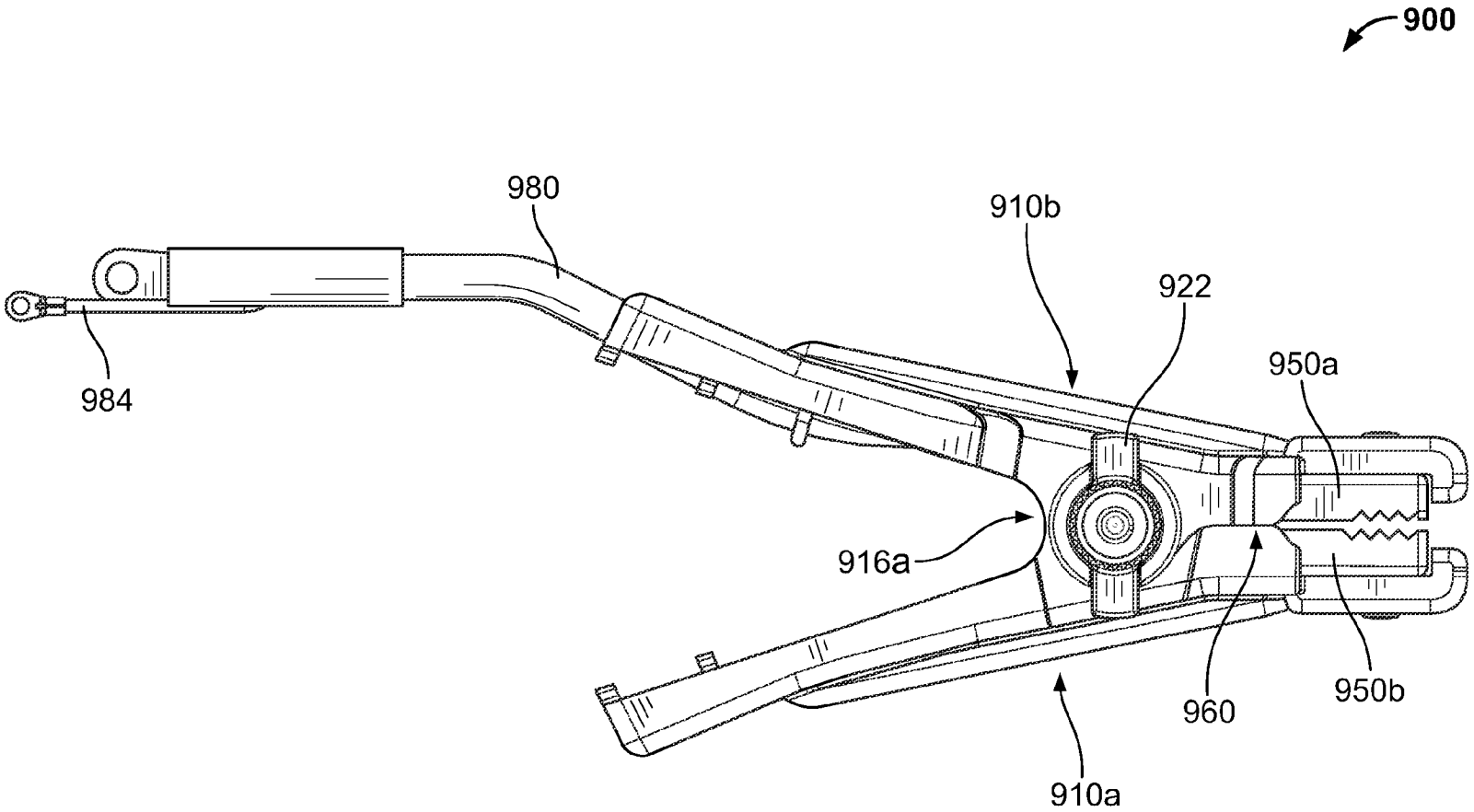
FIG. 9C is a side view of the other side of the battery clamp of FIG. 9A.
Figure 9D:
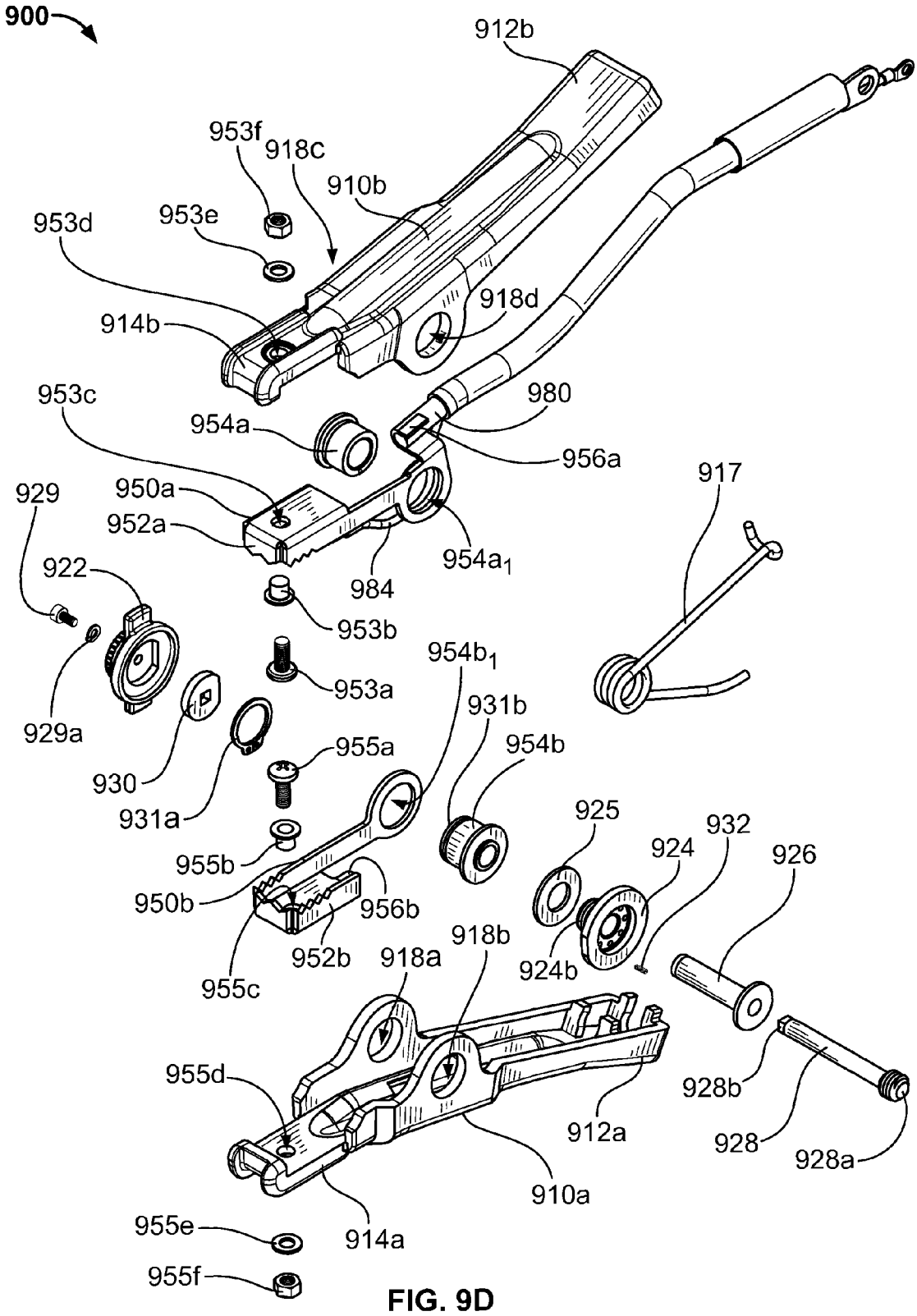
FIG. 9D is an exploded view of the battery clamp of FIG. 9A.

According to certain embodiments, as shown in FIG. 9D, the first jaw handle 910*a* includes a first aperture 918*a* and a second aperture 918*b*, and the second jaw handle 910*b* includes a third aperture 918*c* (hidden in FIG. 9D) and a fourth aperture 918*d*. According to some embodiments, when the first jaw handle 910*a* is attached or coupled to the second jaw handle 910*b*, the first and the third apertures 918*a,c* are aligned with each other to form a first pivot point 916*a*, as shown in FIG. 9C. Similarly, the second and the fourth apertures 918*b,d* become aligned to form a second pivot point 916*b*, as shown in FIG. 9B. It is contemplated that various combinations exist for the number and location of apertures for the jaw handles.

According to some embodiments, the side post adapter assembly 920 is attached or coupled to the battery clamp 900 through the first and second pivot points 916*a,b*. The connection of the side post adapter assembly 920 pivotally connects the two jaw handles 910*a,b*. According to some embodiments, the side post adapter assembly 920 is coupled with the first and the second jaw members 950*a,b*, as best shown in FIG. 9F. In certain embodiments, the jaw handles 910*a,b* are biased in closed position by a biasing member 917. The biasing member 917 (shown in FIG. 9E) biases the clamping portions 914*a,b* towards each other in a closed position, as shown in FIG. 9A. According to some embodiments, the biasing member 917 is the same as or similar to the biasing member 117 described above in reference to the battery clamp 100.

According to certain embodiments, the side post adapter assembly 920, as shown in FIGS. 9A and 9F, includes a handle 922, a load pad 924, an insulating member 926, and a volt rod 928. According to certain embodiments, the handle 922, the load pad 924, the insulating member 926, and the volt rod 928 are the same as or similar to the handle 122, the load pad 124, the insulating member 126, and the volt rod 128 respectively, described above in reference to the battery clamp 100.

According to some embodiments, the load pad 924 has a generally circular face with an aperture. The aperture is configured to receive the insulating member 926 therethrough and a portion of the volt rod 928. According to some embodiments, the load pad 924 includes a threaded portion 924*b* configured to electrically connect the load pad 924 and the first jaw member 950*a* via a washer 925. According to some embodiments, the load pad 924 can optionally include a second aperture positioned to receive a setscrew or a pin 932, shown in FIG. 9D. According to some embodiments, the set screw or pin 932 is coupled to the load pad 924 and the jaw pivot portion 954*a* of the first jaw member 950*a* to inhibit the load pad 924 from rotating with respect to the first jaw member 950*a*.

According to some embodiments, the volt rod 928 has a generally cylindrical shape with two opposing ends 928*a,b*. The first end 928*a* includes a threaded portion and the second end 928*b* is substantially smooth. According to some embodiments, the handle 922 is rigidly connected to the volt rod 928 such that when the handle 922 is turned, the volt rod 928 turns. According to some embodiments, the second end 928*b* of the volt rod 928 is configured to mechanically and electrically connect with a volt pad 930. According to certain embodiments, volt pad 930 is the same as or similar to the volt pad 130 described above in reference to the battery clamp 100.

In certain embodiments, the second end 928*b* of the volt rod 928 may have an inner threaded portion adapted to receive a screw 929. According to some embodiments, the screw 929 is positioned through a washer 929*a* and then through the handle 922 to attach to the volt rod 928. In certain embodiments, it is contemplated that the side post adapter assembly 920 does not include a screw 929 and/or a washer 929*a*. According to some embodiments, the volt pad 930 is configured to fit within a groove or lip in the handle 922 such that when the handle 922 is securely coupled to the volt rod 928, the handle 922 forces the volt pad 930 into electrical contact with the jaw pivot portion 954*b* of the second jaw member 950*b*.

According to some embodiments, the first and the second jaw members 950*a,b* are similar to the first and the second jaw members 150*a,b* described above in reference to battery clamp 100. According to some embodiments, the jaw members 950*a,b* each contain jaw clamp portions 952*a,b*, jaw pivot portions 954*a,b*, and jaw wire connection portions 956*a,b*. The first jaw member 950*a* is also referred to as a load jaw. In certain embodiments, during operation of the battery clamp 900, the load jaw 950*a* is used to conduct current flowing from a battery to a measuring and/or charging device. The second jaw member 950*b* is also referred to as a volt jaw. In certain embodiments, during operation of the battery clamp device 900, the volt jaw 950*b* is used in measuring voltage across a battery's terminals.

According to some embodiments, the jaw clamp portions 952*a,b* of the jaw members 950*a,b* are adapted to be coupled to the clamping portions 914*a,b* of the jaw handles 910*a,b*. As best shown in FIG. 9D, the jaw clamp portion 952*a* of the first jaw member 950*a* is attached or coupled to the clamping portion 914*b* of the second jaw handle 910*b*. Specifically, an insulating bushing 953*b* is positioned through aperture 953*c* in the jaw clamp portion 952*a* of the first jaw member 950*a* and through aperture 953*d* in the clamping portion 914*b* of the second jaw handle 910*b*. A screw 953*a* or other fastener is positioned through the insulating bushing 953*b*, through a washer 953*e*, and coupled with a nut 953*f* to secure the first jaw member 950*a* to the second jaw handle 910*b*. Similarly, the jaw clamp portion 952*b* of the second jaw member 950*b* is attached or coupled to the clamping portion 914*a* of the first jaw handle 910*a*. Specifically, an insulating bushing 955*b* is positioned through aperture 955*c* in the jaw clamp portion 952*b* of the second jaw member 950*b* and through aperture 955*d* in the clamping portion 914*a* of the first jaw handle 910*a*. A screw 955*a* or other fastener is positioned through the insulating bushing 955*b*, through a washer 955*e*, and coupled with a nut 955*f* to secure the second jaw member 950*b* to the first jaw handle 910*a*.

According to some embodiments, the jaw clamping portions 914*a,b* have a width equal to or less than the width of the jaw members 950*a,b*. Such a design aids an operator of the battery clamp 900 in connecting/clamping the battery clamp 900 with a side post terminal of a side post battery. Such a connection using the jaw members 950*a,b* rather than the side post adapter assembly 920 is useful when the side terminal battery remains connected to wires in an automobile.

The jaw pivot portions 954*a,b* are adapted to be pivotally coupled about the first and second pivot points 916*a,b*. According to some embodiments, the jaw pivot portion 954*a* of the first jaw member 950*a* is pivotally coupled about the second pivot point 916*b*. Similarly, the jaw pivot portion 954*b* of the second jaw member 950*b* is pivotally coupled about the first pivot point 916*a*. As shown in FIG. 9D, according to some embodiments, the jaw pivot portion 954*a* is coupled to the first jaw member 950*a* via aperture 954$a_1$. Similarly, according to some embodiments, the jaw pivot portion 954*b* is coupled to the second jaw member 950*b* via aperture 954$b_1$.

According to some embodiments, the side post adapter assembly 920 optionally includes a retainer ring 931*a*, shown in FIG. 9D. The retainer ring 931*a* can be configured to snap or clip into a groove 931*b* in an exterior end of the jaw pivot portion 954*b* of the second jaw member 950*b*. The retainer ring 931*a* maintains the exterior end of the jaw pivot portion 954*b* of the second jaw member 950*b* positioned through apertures 918*a,c*. It is contemplated that according to some embodiments, a retainer ring can be employed to maintain an exterior end of the jaw pivot portion 954*a* of the first jaw member 950*a* positioned through apertures 918*b,d*.

According to some embodiments, the jaw wire connection portions 956*a,b*, best shown in FIGS. 9D and 9F, are adapted to be operatively connected with, or coupled to, electrical wires. Specifically, the jaw wire connection portion 956*a* of the load jaw 950*a* is adapted to be connected to a first insulated wire, also referred to as a load wire 980, shown in FIG. 9D. In certain embodiments, the jaw wire connection portion 956*a* is crimped, crushed, and/or soldered around a stripped portion of the load wire 980. According to some embodiments, a portion of the load wire 980 is stripped, the jaw wire connection portion 956*a* is crimped around the stripped portion, and the jaw wire connection portion 956*a* is dipped in molten solder. According to certain embodiments, the load wire 980 is electrically connected to the jaw wire connection portion 956*a* of the first jaw member 950*a* and electrically connected to the load pad 924.

Figure 9E:
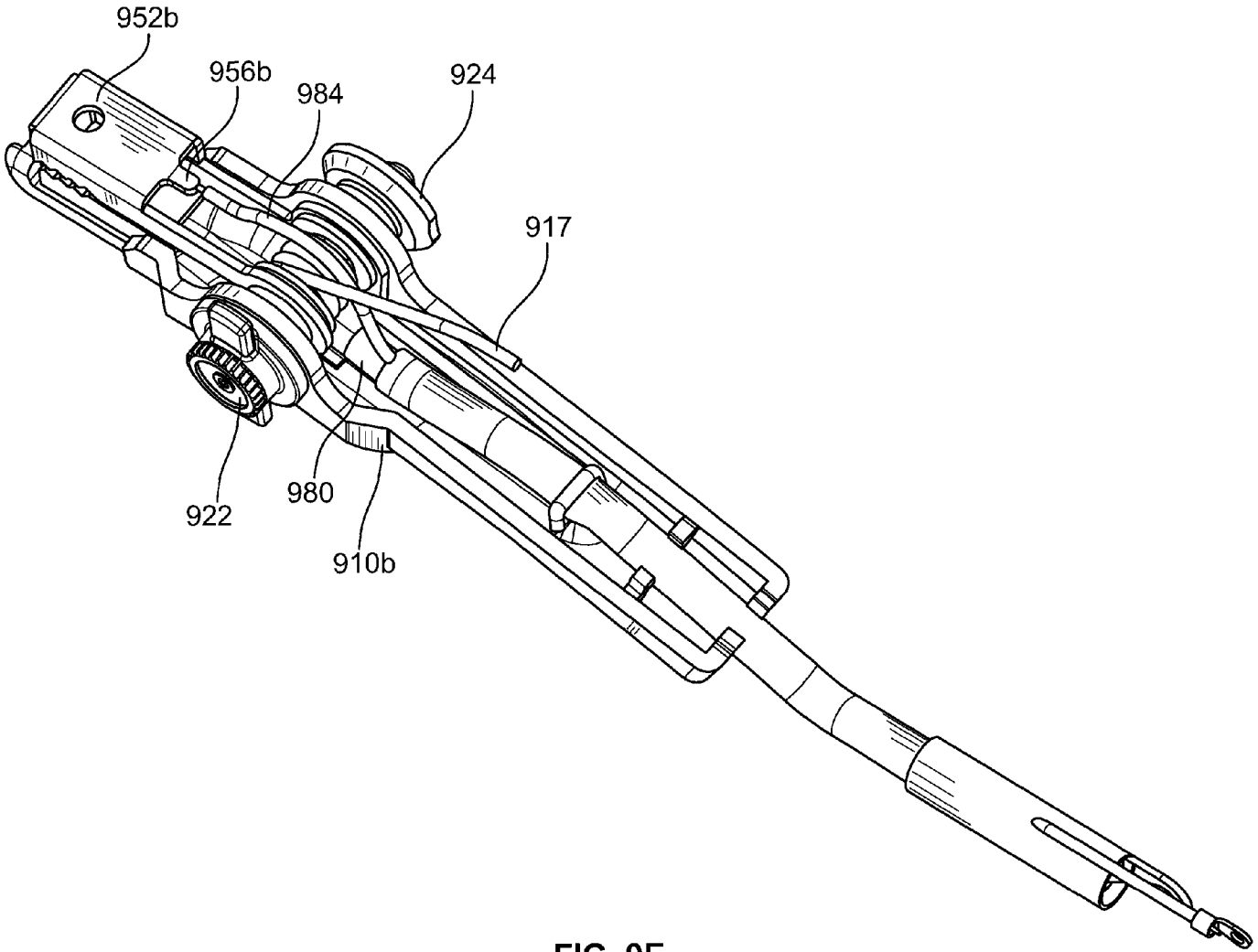
FIG. 9E is a partial perspective view of battery clamp of FIG. 9A.
Figure 9F:
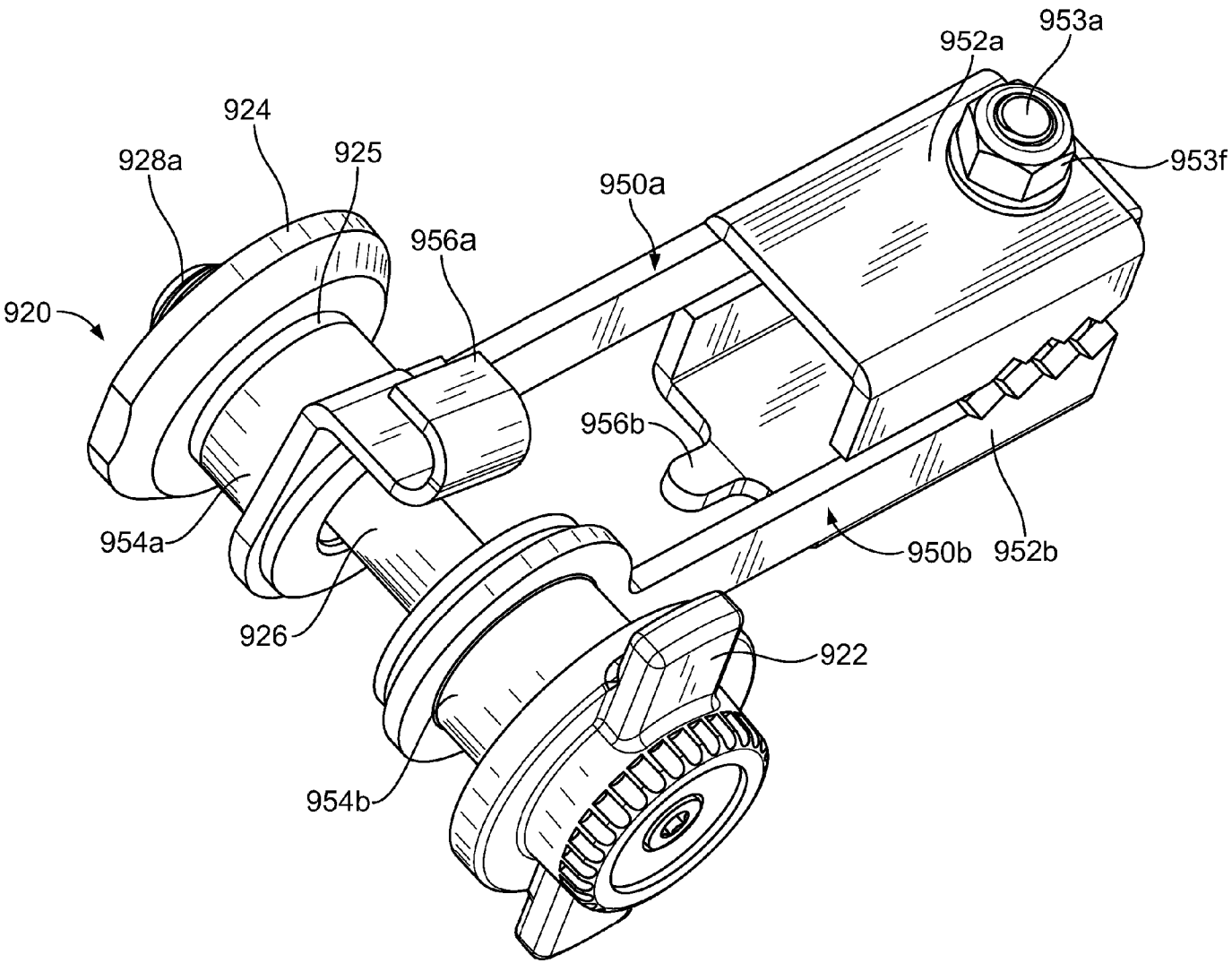
FIG. 9F is a partial perspective view of a side post adapter and jaw member assembly of the battery clamp of FIG. 9A.

The jaw wire connection portion 956*b* of the volt jaw 950*b* is adapted to be connected with, or coupled to, a second insulated wire, also referred to as a volt wire 984, as shown in FIG. 9E. In certain embodiments, a stripped portion of the volt wire 984 is soldered to the jaw wire connection portion 956*b*. The volt wire 984 is electrically connected to the jaw wire connection portion 956*b* of the second jaw member 950*b* and electrically connected to the volt rod 928. Other methods suitable for attaching both the load wire 980 and the volt wire 984 are contemplated. According to some embodiments, the load wire 980 and the volt wire 984 are the same as or similar to the load wire 180 and the volt wire 184 described above in reference to the battery clamp 100.

According to some embodiments, the jaw handles 910*a,b* further include a stopping mechanism 960, as shown in FIGS. 9A-C. According to some embodiments, the stopping mechanism 960 is the same as or similar to the stopping mechanism 560 described above in reference to the battery clamp 500. According to some embodiments, the stopping mechanism 960 prevents the jaw clamp portions 952*a,b* of the jaw members 950*a,b* from touching when the jaw handles 910*a,b* are biased in a closed position. For example, as shown, the jaw handles 910*a,b* are in the closed position, yet the built-in stopping mechanism 960 prevents the jaw clamp portion 952*a* of the first jaw member 950*a* from contacting the jaw clamp portion 952*b* of the second jaw member 950*b*. According to some embodiments, the stopping mechanism 960 is formed as a part of one or both of the jaw handles 910*a,b*.

ALTERNATIVE EMBODIMENTS

Alternative Embodiment 1

A battery clamp for use with (a) batteries with top post terminal connections and (b) batteries with side post terminal connections includes a first and second jaw handle, each of the first and second jaw handles having a handle portion and a clamping portion, the first and second jaw handles being pivotally coupled together, the jaw handles being biased with the clamping portions being in a closed position; a first and second jaw member, each of the jaw members having a jaw clamp portion, a jaw pivot portion, and a jaw wire connection portion, the jaw pivot portion of the first jaw member being pivotally coupled to the first and second jaw handles, the jaw pivot portion of the second jaw member being pivotally coupled to the first and second jaw handles; a load pad electrically coupled to the first jaw member, the load pad having an aperture; and a volt rod electrically coupled to the second jaw member, a portion of the volt rod protruding through the aperture of the load pad.

Alternative Embodiment 2

The battery clamp of alternative embodiment 1, wherein the first jaw handle further includes a first aperture and a second aperture, and the second jaw handle further includes a third aperture and a fourth aperture.

Alternative Embodiment 3

The battery clamp of alternative embodiment 2, wherein the first aperture and the third aperture are positioned adjacent each other and form a first pivot point, and the second aperture and the fourth aperture are positioned adjacent each other and form a second pivot point.

Alternative Embodiment 4

The battery clamp of alternative embodiment 3, wherein the jaw pivot portion of the first jaw member is pivotally coupled about the first pivot point, and the jaw pivot portion of the second jaw member is pivotally coupled about the second pivot point.

Alternative Embodiment 5

The battery clamp of alternative embodiment 3 or 4, wherein the load pad is electrically coupled to the first jaw member through the jaw pivot portion of the first jaw member.

Alternative Embodiment 6

The battery clamp according to any of alternative embodiments 1 to 5, wherein the first and second jaw members are electrically insulated from the first and second jaw handles.

Alternative Embodiment 7

The battery clamp according to any of alternative embodiments 1 to 6, wherein the jaw clamp portion of the first jaw member is coupled to the clamping portion of the second jaw handle, the jaw clamp portion of the second jaw member is coupled to the clamping portion of the first jaw handle.

Alternative Embodiment 8

The battery clamp according to any of alternative embodiments 1 to 7, wherein the jaw clamp portions of the jaw members are coupled to the clamping portions of the jaw handles by at least one of a screw connection, a solder connection, a glue connection, a nut and bolt connection, and a force fit connection.

Alternative Embodiment 9

The battery clamp according to any of alternative embodiments 1 to 8, wherein the volt rod includes a first and a second opposing end, the first opposing end including a threaded portion.

Alternative Embodiment 10

The battery clamp of alternative embodiment 9, wherein the threaded portion is made of stainless steel.

Alternative Embodiment 11

The battery clamp of alternative embodiment 9, further comprising a handle connected to the second opposing end of the volt rod, whereby the handle is coupled to the volt rod such that the volt rod rotates when the handle is rotated thereby permitting the threaded portion of the volt rod to be screwed into a battery terminal by rotating the handle.

Alternative Embodiment 12

The battery clamp of alternative embodiment 11, wherein the second opposing end is configured to connect with the handle via at least one of a wedge connection, a screw connection, a pin connection, a key connection, a press fit connection, and a solder connection.

Alternative Embodiment 13

The battery clamp of alternative embodiment 11, wherein the handle is one of a knob, a turn screw, a wheel, and a sprocket.

Alternative Embodiment 14

The battery clamp of claim 1, wherein the volt rod is further electrically coupled to a volt pad, the volt pad being electrically coupled to the second jaw member.

Alternative Embodiment 15

The battery clamp according to any of alternative embodiments 1 to 14, wherein the first jaw member is electrically insulated from the second jaw member.

Alternative Embodiment 16

The battery clamp according to any of alternative embodiments 1 to 15, further including a stopping mechanism, the stopping mechanism configured to prevent the first jaw member from contacting the second jaw member when the jaw handles are in the closed position.

Alternative Embodiment 17

The battery clamp of alternative embodiment 16, wherein the stopping mechanism comprises at least one tab on at least one of the jaw handles.

Alternative Embodiment 18

The battery clamp of alternative embodiments 1 to 17, wherein the load pad is operatively coupled to the jaw pivot portion of the first jaw member.

Alternative Embodiment 19

The battery clamp according to any of alternative embodiments 1 to 18, further comprising a first insulated wire electrically connected to the first jaw member and electrically coupled to the load pad.

Alternative Embodiment 20

The battery clamp of alternative embodiment 19, wherein the first insulated wire is a load wire connected to a device configured to at least measure current.

Alternative Embodiment 21

The battery clamp of alternative embodiment 20, wherein the device measures current levels between about ½ amp and about 800 amps.

Alternative Embodiment 22

The battery clamp according to any of alternative embodiments 1 to 19, further including a second insulated wire electrically connected to the second jaw member and electrically coupled to the volt rod.

Alternative Embodiment 23

The battery clamp of alternative embodiment 22, wherein the second insulated wire is a volt wire connected to a device configured to at least measure voltage.

Alternative Embodiment 24

The battery clamp according to any of alternative embodiments 1 to 23, further including an insulating member coupled to the load pad, the insulating member configured to electrically insulate the load pad from the volt rod.

Alternative Embodiment 25

A battery clamp for use with (a) batteries with top post terminal connections and (b) batteries with side post terminal connections including a first and second jaw handle, the first and second jaw handles each having a handle portion and a clamping portion, the first and second jaw handles being pivotally coupled together, the jaw handles being biased with the clamping portions being in a closed position; a first and second jaw member coupled to the clamping portions of the first and second jaw handles, the first and second jaw members being configured to clamp onto a top-post terminal of a top-post battery; a side post adapter configured to be coupled to a side-post terminal of a side-post battery, the side post adapter comprising a load pad and a volt rod; a volt wire electrically coupled to the volt rod; and a load wire electrically coupled to the load pad.

Alternative Embodiment 26

The battery clamp of alternative embodiment 25, wherein the volt rod and volt wire are electrically insulated from the load pad and the load wire.

Alternative Embodiment 27

The battery clamp of alternative embodiments 25 or 26, wherein the load pad is electrically coupled to the first jaw member.

Alternative Embodiment 28

The battery clamp according to any of alternative embodiments 25 to 27, wherein the volt rod is electrically coupled to the second jaw member.

Alternative Embodiment 29

The battery clamp according to any of alternative embodiments 25 to 28, wherein the first and second jaw members are electrically insulated from each other.

Alternative Embodiment 30

The battery clamp according to any of alternative embodiments 25 to 29, wherein the volt rod includes a first and a second opposing end, the first end having a threaded portion.

Alternative Embodiment 31

The battery clamp of alternative embodiment 30, wherein the threaded portion is made of stainless steel.

Alternative Embodiment 32

The battery clamp of alternative embodiment 30 or 31, further comprising a handle connected to the second opposing end of the volt rod, whereby the handle is coupled to the volt rod such that the volt rod rotates when the handle is rotated thereby permitting the threaded portion of the volt rod to be screwed into a battery terminal by rotating the handle.

Alternative Embodiment 33

The battery clamp according to any of alternative embodiments 25 to 32, further including a stopping mechanism, the stopping mechanism configured to prevent the first jaw member from contacting the second jaw member when the jaw handles are in the closed position.

Alternative Embodiment 34

The battery clamp of alternative embodiment 33, wherein the stopping mechanism comprises at least one tab on at least one of the jaw handles.

Alternative Embodiment 35

The battery clamp according to any of alternative embodiments 25 to 34, wherein the first and second jaw handles pivot about a pivot axis, the load pad being coupled to the first and second jaw handles near the pivot axis.

Alternative Embodiment 36

A battery clamp for use with (a) batteries with top post terminal connections and (b) batteries with side post terminal connections including a first and second jaw handle, the first and second jaw handles each having a handle portion and a clamping portion, the first and second jaw handles being pivotally coupled to each other, the jaw handles being biased with the clamping portions being in a closed position; and a side post adapter, the side post adapter being coupled to the handle portion of one of the jaw handles, the side post adapter including a load pad and a volt rod, the load pad having an aperture, a portion of the volt rod protruding through the aperture of the load pad.

Alternative Embodiment 37

A method of testing a battery having side post terminal connections including providing a pair of battery clamps, each of the pair of battery clamps including a side post adapter, each of the side post adapters including a load pad and a volt rod; inserting each of the volt rods into a respective side post terminal in the battery; rotating each of the volt rods to cause the load pads to become electrically coupled to respective lead pads on the battery; applying a load to the battery; and measuring at least one of a current and a voltage of the battery.

Alternative Embodiment 38

A method of charging a battery having side post terminal connections including providing a pair of battery clamps, each of the pair of battery clamps comprising a side post adapter, each of the side post adapters including a load pad and a volt rod; inserting each of the volt rods into a respective side post terminal in the battery; rotating each of the volt rods to cause the load pads to become electrically coupled to respective lead pads on the battery; and applying a charge to the battery.

Alternative Embodiment 39

A method of testing a battery having top post terminal connections including providing a pair of battery clamps, each of the pair of battery clamps comprising a side post adapter, each of the side post adapters including a load pad and a volt rod; clamping each of the pair of battery clamps onto a respective top post terminal on the battery; applying a load to the battery; and measuring at least one of a current and a voltage of the battery.

Alternative Embodiment 40

A battery clamp for use with (a) batteries with top post terminal connections and (b) batteries with side post terminal connections including a first and second jaw handle, each of the first and second jaw handles having a handle portion and a clamping portion, the first and second jaw handles being pivotally coupled together, the jaw handles being biased with the clamping portions being in a substantially closed position; a jaw member insulator coupled to the clamping portion of the first jaw handle; a jaw member coupled to the jaw member insulator, the jaw member insulator electrically insulating the jaw member from the first and second jaw handles; a load pad electrically coupled to the jaw member, the load pad having an aperture; and a volt rod electrically coupled to the first and second jaw handles, a portion of the volt rod protruding through the aperture of the load pad.

Alternative Embodiment 41

The battery clamp of alternative embodiment 40, wherein the first jaw handle further includes a first aperture and a second aperture, and the second jaw handle further includes a third aperture and a fourth aperture.

Alternative Embodiment 42

The battery clamp of alternative embodiment 41, wherein the first aperture and the third aperture are positioned adjacent each other and form a first pivot point, and the second aperture and the fourth aperture are positioned adjacent each other and form a second pivot point.

Alternative Embodiment 43

The battery clamp according to any of alternative embodiments 40 to 42, wherein the jaw member insulator is an insulating sleeve.

Alternative Embodiment 44

The battery clamp according to any of alternative embodiments 40 to 43, wherein the volt rod includes a threaded end and a second opposing end.

Alternative Embodiment 45

The battery clamp of alternative embodiment 44, wherein the threaded end is made of stainless steel.

Alternative Embodiment 46

The battery clamp of alternative embodiment 44 or 45, further comprising a handle connected to the second opposing end of the volt rod, whereby the handle is coupled to the volt rod such that the volt rod rotates when the handle is rotated thereby permitting the threaded end portion of the volt rod to be screwed into a battery terminal by rotating the handle.

Alternative Embodiment 47

The battery clamp of alternative embodiment 46, wherein the second opposing end is configured to connect with the handle via at least one of a wedge connection, a screw connection, a pin connection, a key connection, a press fit connection, and a solder connection.

Alternative Embodiment 48

The battery clamp of alternative embodiment 46 or 47, wherein the handle is one of a knob, a turn screw, a wheel, and a sprocket.

Alternative Embodiment 49

The battery clamp according to any of alternative embodiments 40 to 48, further including a stopping mechanism, the stopping mechanism configured to prevent the jaw member from contacting the clamping portion of the second jaw handle when the first and second jaw handles are in the substantially closed position.

Alternative Embodiment 50

The battery clamp of alternative embodiment 49, wherein the stopping mechanism comprises at least one spacer coupled to the clamping portion of each of the first and second jaw handles.

Alternative Embodiment 51

The battery clamp according to any of alternative embodiments 40 to 50, further comprising a first insulated wire electrically coupled to the load pad.

Alternative Embodiment 52

The battery clamp of alternative embodiment 51, wherein the first insulated wire is a load wire connected to a device configured to at least measure current.

Alternative Embodiment 53

The battery clamp of alternative embodiment 52, wherein the device measures current levels between about 0 amps and about 40 amps.

Alternative Embodiment 54

The battery clamp according to any of alternative embodiments 40 to 53, further including a second insulated wire electrically coupled to the volt rod.

Alternative Embodiment 55

The battery clamp of alternative embodiment 54, wherein the second insulated wire is a volt wire connected to a device configured to at least measure a voltage potential.

Alternative Embodiment 56

The battery clamp according to any of alternative embodiments 40 to 54, further including a third insulated wire, wherein the third insulated wire is a load jumper wire that electrically couples the jaw member to the load pad, the load wire, or both.

Alternative Embodiment 57

The battery clamp according to any of alternative embodiments 40 to 56, further including an insulating disk coupled to the load pad, the insulating disk configured to electrically insulate the load pad from the volt rod and the first and second jaw handles.

Alternative Embodiment 58

A battery clamp for use with (a) batteries with top post terminal connections and (b) batteries with side post terminal connections including a first and second jaw handle, the first and second jaw handles each having a handle portion and a clamping portion, the first and second jaw handles being pivotally coupled together, the jaw handles being biased with the clamping portions being in a substantially closed position, the clamping portions being configured to be coupled to a top-post terminal of a top-post battery; a jaw member coupled to the clamping portion of the first jaw handle; a side post adapter configured to be coupled to a side-post terminal of a side-post battery, the side post adapter comprising a load pad and a volt rod; a volt wire electrically coupled to the volt rod; a load wire electrically coupled to the load pad; and a load jumper wire electrically coupled between the load pad and the jaw member.

Alternative Embodiment 59

The battery clamp of alternative embodiment 58, wherein the volt rod and volt wire are electrically insulated from the load pad, the load wire, and the load jumper wire.

Alternative Embodiment 60

The battery clamp of alternative embodiment 58 or 59, wherein the volt rod is electrically coupled to the first and second jaw handles and the jaw member is electrically insulated from the first and second jaw handles.

Alternative Embodiment 61

The battery clamp according to any of alternative embodiments 58 to 60, wherein the volt rod includes a threaded end and a second opposing end.

Alternative Embodiment 62

The battery clamp of alternative embodiment 61, wherein the threaded end is made of stainless steel.

Alternative Embodiment 63

The battery clamp of alternative embodiment 61 or 62, further comprising a handle connected to the second opposing end of the volt rod, whereby the handle is coupled to the volt rod such that the volt rod rotates when the handle is rotated thereby permitting the threaded end of the volt rod to be screwed into a battery terminal by rotating the handle.

Alternative Embodiment 64

The battery clamp according to any of alternative embodiments 58 to 63, further including a stopping mechanism, the stopping mechanism configured to prevent the jaw member from contacting the clamping portion of the second jaw handle when the first and second jaw handles are in the substantially closed position.

Alternative Embodiment 65

The battery clamp of alternative embodiment 64, wherein the stopping mechanism comprises at least one spacer on each of the first and second jaw handles.

Alternative Embodiment 66

A battery clamp for use with (a) batteries with top post terminal connections and (b) batteries with side post terminal connections including a first and second jaw handle, the first and second jaw handles each having a handle portion and a clamping portion, the first and second jaw handles being pivotally coupled to each other, the jaw handles being biased with the clamping portions being in a substantially closed position, the clamping portions being configured to be coupled to a top-post terminal of a top-post battery; a jaw member insulator coupled to the clamping portion of the first jaw handle; a jaw member coupled to the jaw member insulator, the jaw member being electrically insulated from the first and second jaw handles; a side post adapter, the side post adapter being coupled to the handle portion of the first jaw handle, the side post adapter including a load pad and a volt rod, the load pad having an aperture, a portion of the volt rod protruding through the aperture of the load pad.

Alternative Embodiment 67

The battery clamp of alternative embodiment 66, further comprising a first and second jaw handle cover, the first jaw handle cover being coupled to the first jaw handle, the second jaw handle cover being coupled to the second jaw handle.

Alternative Embodiment 68

The battery clamp of alternative embodiment 67, wherein the first and second jaw handle covers are formed from an insulating material.

Alternative Embodiment 69

The battery clamp according to any of alternative embodiments 66 to 68, further comprising an insulating disk positioned to electrically insulate the load pad from the second jaw handle and the volt rod.

Alternative Embodiment 70

The battery clamp according to any of alternative embodiments 66 to 69, wherein the volt rod has a threaded end and an opposing second end, the volt rod further including a flange.

Alternative Embodiment 71

The battery clamp of alternative embodiment 70, further comprising an insulating plate with an aperture and a recess, the second end of the volt rod fitting through the aperture in the insulating plate such that the recess receives the flange of the volt rod, the insulating plate positioned to aid in providing an electrical connection between the volt rod and the second jaw handle.

Alternative Embodiment 72

The battery clamp according to any of alternative embodiments 66 to 71, further comprising a pair of insulating bushings, each of the insulating bushings having an extended sleeve portion.

Alternative Embodiment 73

The battery clamp of alternative embodiment 72, wherein the extended sleeve portions of the insulating bushings are positioned to fit through respective apertures in the insulating plate, the second jaw handle, and the insulating disk.

Alternative Embodiment 74

The battery clamp of alternative embodiment 73, further comprising a pair of electrically conductive screws, the screws being positioned through the extended sleeve portions of the insulating bushings so as to grip threads in a pair of respective threaded apertures in the load pad, the screws being electrically insulated from the first jaw handle, the second jaw handle, and the volt rod.

Alternative Embodiment 75

The battery clamp according to any of alternative embodiments 66 to 74, further comprising a load wire and a load jumper wire, the load wire being connected to a device to at least measure current, the load jumper wire electrically connected to the jaw member.

Alternative Embodiment 76

The battery clamp of alternative embodiment 75, wherein the load wire and the load jumper wire are electrically coupled to the load pad via at least one of the screws.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention.

What is claimed is:

1. A battery clamp for use with (a) batteries with top post terminal connections and (b) batteries with side post terminal connections, comprising:

a first jaw handle and a second jaw handle, the jaw handles each having a handle portion and a clamping portion, the jaw handles being pivotally coupled to each other, the jaw handles being biased with the clamping portions being in a substantially closed position, the clamping portions being configured to be coupled to a top-post terminal of a top-post battery;

a jaw member insulator coupled to the clamping portion of the first jaw handle;

a jaw member coupled to the jaw member insulator, the jaw member being electrically insulated from the first and the second jaw handles; and a side post adapter, the side post adapter being coupled to the handle portion of the second jaw handle, the side post adapter including a load pad and a volt rod, the load pad having an aperture therein, a portion of the volt rod protruding through the aperture of the load pad.

2. The battery clamp of claim 1, further comprising a first jaw handle cover and a second jaw handle cover, the first jaw handle cover being coupled to the first jaw handle, the second jaw handle cover being coupled to the second jaw handle, the jaw handle covers being formed from an insulating material.

3. The battery clamp of claim 1, further comprising an insulating disk positioned to electrically insulate the load pad from the second jaw handle and the volt rod.

4. The battery clamp of claim 3, wherein the volt rod has a threaded end and an opposing second end, the volt rod further including a flange.

5. The battery clamp of claim 4, further comprising an insulating plate with an aperture and a recess, the second end of the volt rod fitting through the aperture in the insulating plate such that the recess receives the flange of the volt rod, the insulating plate positioned to aid in providing an electrical connection between the volt rod and the second jaw handle.

6. The battery clamp of claim 4, further comprising a handle connected to the second opposing end of the volt rod, whereby the handle is coupled to the volt rod such that the volt rod rotates in response to the handle being rotated thereby permitting the threaded end of the volt rod to be screwed into a battery terminal by rotating the handle.

7. The battery clamp of claim 5, further comprising a first insulating bushing and a second insulating bushing, each of the insulating bushings having an extended sleeve portion, the extended sleeve portions being positioned to fit through respective apertures in the insulating plate, the second jaw handle, and the insulating disk.

8. The battery clamp of claim 7, further comprising a pair of electrically conductive screws, the screws being positioned through the extended sleeve portions of the insulating bushings so as to grip threads in a pair of respective threaded apertures in the load pad, the screws being electrically insulated from the first jaw handle, the second jaw handle, and the volt rod.

9. The battery clamp of claim 8, further comprising a load wire electrically coupled to the load pad and electrically connected to a device configured to at least measure current.

10. The battery clamp of claim 9, further including a load jumper wire that electrically couples the jaw member to the load pad, the load wire, or both.

11. The battery clamp of claim 9, wherein the device measures current levels between about 0 amps and about 40 amps.

12. The battery clamp of claim 10, wherein the load wire and the load jumper wire are electrically coupled to the load pad via at least one of the screws.

13. The battery clamp of claim 1, further including a volt wire electrically coupled to the volt rod and electrically connected to a device configured to at least measure a voltage potential.

14. The battery clamp of claim 1, wherein the first jaw handle further includes a first aperture and a second aperture, and the second jaw handle further includes a third aperture and a fourth aperture, the first aperture and the third aperture are positioned adjacent each other and form a first pivot point, and the second aperture and the fourth aperture are positioned adjacent each other and form a second pivot point.

15. The battery clamp of claim 1, further including a stopping mechanism, the stopping mechanism configured to prevent the jaw member from contacting the clamping portion of the second jaw handle when the first and second jaw handles are in the substantially closed position.

16. A battery clamp comprising:

a first jaw handle and a second jaw handle, the jaw handles being pivotally coupled to each other and biased in a substantially closed position;

a jaw member coupled to the first jaw handle or the second jaw handle, the jaw member being electrically insulated from the first and the second jaw handles; and a side post adapter coupled to the first jaw handle or the second jaw handle, the side post adapter including a load pad and a volt rod, wherein the side post adapter is configured to mate with a side post terminal of a battery.

17. The battery clamp of claim 16, wherein the load pad has an aperture therein and a portion of the volt rod protrudes through the aperture.

18. The battery clamp of claim 16, further comprising a jaw member insulator, the jaw member insulator being positioned between the jaw member and the first jaw handle or the second jaw handle.

19. The battery clamp of claim 16, further comprising a second jaw member, the second jaw member being electrically insulated from the first and the second jaw handles.

20. The battery clamp of claim 16, wherein the first jaw handle and the second jaw handle are made from an electrically conducting material.

* * * * *